US011793326B1

(12) United States Patent
Flannery et al.

(10) Patent No.: US 11,793,326 B1
(45) **Date of Patent: *Oct. 24, 2023**

(54) BASSINET APPARATUS

(71) Applicant: Regalo International, LLC, Burnsville, MN (US)

(72) Inventors: Mark A. Flannery, Longboat Key, FL (US); William D. Butterfield, River Falls, WI (US)

(73) Assignee: Regalo International, LLC, Burnsville, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/548,531

(22) Filed: Dec. 11, 2021

Related U.S. Application Data

(63) Continuation of application No. 16/827,693, filed on Mar. 23, 2020, now Pat. No. 11,202,519.

(51) Int. Cl.
*A47D 9/00* (2006.01)
*A47D 9/02* (2006.01)
*A47D 7/04* (2006.01)

(52) U.S. Cl.
CPC ..... *A47D 9/005* (2013.01); *A47D 7/04* (2013.01); *A47D 9/02* (2013.01)

(58) Field of Classification Search
CPC . A47D 9/00; A47D 9/005; A47D 9/02; A47D 9/04; A47D 7/03; A47D 7/04
See application file for complete search history.

(56) References Cited

U.S. PATENT DOCUMENTS

| | | | | |
|---|---|---|---|---|
| 887,529 | A * | 5/1908 | Schnee | A47D 7/04 5/96 |
| 5,819,340 | A * | 10/1998 | Kelly | A47D 7/04 5/93.1 |
| 6,182,308 | B1 * | 2/2001 | Yang | A47D 13/063 24/616 |
| 7,908,689 | B2 * | 3/2011 | Flannery | A47C 21/08 5/426 |
| 8,091,163 | B2 | 1/2012 | Flannery | |
| 8,365,324 | B2 | 2/2013 | Flannery | |
| 8,631,525 | B2 | 1/2014 | Flannery | |
| 9,125,498 | B2 | 9/2015 | Flannery | |
| 9,387,141 | B1 * | 7/2016 | Flannery | A61G 7/0507 |
| 9,687,081 | B1 | 6/2017 | Flannery | |
| 10,548,408 | B1 | 2/2020 | Flannery et al. | |
| 11,202,519 | B1 * | 12/2021 | Flannery | A47D 9/02 |
| 2001/0044958 | A1 * | 11/2001 | DeAngelo | A47D 7/04 5/95 |
| 2002/0092094 | A1 * | 7/2002 | Welsh, Jr. | A47D 7/04 5/95 |

(Continued)

*Primary Examiner* — David R Hare
*Assistant Examiner* — George Sun

(57) ABSTRACT

A bassinet apparatus having a base with first and second elongate support members parallel to each other. Lower portions of first and second side support member are slideably engaged respectively on the first and second elongate support members. Upper portions of the first and second side support members pivotally engage first and second bassinet support members extending from the upper portion of the first side support member to the upper portion of the second side support member. A bassinet receptacle depends from the first and second bassinet support members.

18 Claims, 14 Drawing Sheets

(56) References Cited

U.S. PATENT DOCUMENTS

| | | | | |
|---|---|---|---|---|
| 2003/0037372 | A1* | 2/2003 | Andriunas | A47D 7/04 5/2.1 |
| 2005/0210581 | A1* | 9/2005 | Clapper | A47D 9/00 5/93.1 |
| 2008/0010742 | A1* | 1/2008 | Tharalson | A47D 5/00 5/95 |
| 2009/0049605 | A1* | 2/2009 | Zhao | A47D 15/00 5/93.1 |
| 2011/0113549 | A1* | 5/2011 | Riddiford | A47D 7/002 5/98.1 |
| 2012/0246824 | A1* | 10/2012 | Friedman | A47D 7/04 5/95 |
| 2013/0125827 | A1* | 5/2013 | Pietra | A01K 1/0272 119/496 |
| 2013/0312178 | A1* | 11/2013 | Jackson | A47D 13/06 5/93.1 |
| 2014/0101847 | A1* | 4/2014 | von Rohrscheidt | A47D 7/04 5/95 |
| 2014/0137324 | A1* | 5/2014 | Doering | A47D 7/04 5/93.1 |
| 2014/0191173 | A1* | 7/2014 | Saint | A47D 13/06 256/25 |
| 2016/0286978 | A1* | 10/2016 | Sclare | A47D 7/005 |
| 2020/0077805 | A1* | 3/2020 | Ning | A47D 7/04 |

* cited by examiner

BASSINET APPARATUS

This application is a continuation of U.S. patent application Ser. No. 16/827,693 filed Mar. 23, 2020 (U.S. Pat. No. 11,202,519 issued Dec. 21, 2021) and claims the benefit thereof under 35 U.S.C. § 120, which application is hereby incorporated by reference its entirety into this application.

FIELD OF THE INVENTION

The present invention generally relates to a bassinet, particularly to a bassinet depending from bassinet support members, and specifically to a bassinet having side support members that pivotally engage the bassinet support members.

BACKGROUND OF THE INVENTION

A bassinet is a place for an infant or baby to sleep or rest. A classic bassinet may be a wicker cradle with a hood. A wicker cradle is a cradle made of pliable twigs, such as willow, that are plaited or woven to make the cradle. The wicker cradle is light and thus portable, permitting the caregiver to keep a sleeping space for the baby close at hand as the caregiver goes from room to room, floor to floor, and from inside the house to the front yard or backyard. At night, the wicker cradle may be placed next to the caretaker's bed.

SUMMARY OF THE INVENTION

A feature of the present invention is a bassinet apparatus.

Another feature of the present invention is the provision in a bassinet apparatus, of a base that includes first and second elongate support members spaced apart from each other, parallel to each other, and fixed relative to each other.

Another feature of the present invention is the provision in a bassinet apparatus, of first and second side support members, where the first side support member is slideable onto the first elongate support member, and where the second side support member is slideable onto the second elongate support member.

Another feature of the present invention is the provision in a bassinet apparatus, of a first bassinet support member extending from the first side support member to the second side support member and of a second bassinet support member extending from the first side support member to the second side support member.

Another feature of the present invention is the provision in a bassinet apparatus, of the first side support member being pivotable relative to the first and second bassinet support members and of the second side support member being pivotable relative to the first and second bassinet support members.

Another feature of the present invention is the provision in a bassinet apparatus, of a bassinet receptacle engaged to and depending from the first and second bassinet support members.

Another feature of the present invention is the provision in a bassinet apparatus, of each of the first and second bassinet support members including an intermediate section, where the intermediate section of the first bassinet support member is disposed transversely of the first and second elongate support members, and where the intermediate section of the second bassinet support member is disposed transversely of the first and second elongate support members.

Another feature of the present invention is the provision in a bassinet apparatus, of the first and second elongate support members defining a first plane, where each of the first and second bassinet support members includes an intermediate section, where the intermediate sections of the first and second bassinet support members define a second plane, and where the second plane is disposed above the first plane.

Another feature of the present invention is the provision in a bassinet apparatus, of each of the first and second side support members including a lower portion and an upper portion, where the first and second elongate support members engage the lower portion, and where the first and second bassinet support members engage the upper portion.

Another feature of the present invention is the provision in a bassinet apparatus, of the first side support member being lockable on the first elongate support member to be rigid relative to the first elongate support member and of the second side support member being lockable on the second elongate support member to be rigid relative to the second elongate support member.

Another feature of the present invention is the provision in a bassinet apparatus, of each of the first and second side support members being lockable and unlockable from a pivoting position with the first and second bassinet support members such that the first and second side support members may assume a rigid position relative to the first and second bassinet support members.

Another feature of the present invention is the provision in a bassinet apparatus, of the bassinet receptacle including at least one of a flexible side and flexible end.

Another feature of the present invention is the provision in a bassinet apparatus, of intermediate sections of the first and second bassinet support members defining a first plane, where each of the first and second side support members define a second plane, where each of the first and second side support members are lockable to the first and second bassinet support members, and where the first and second planes are oblique to each other when the first and second side support members are locked to the first and second bassinet support members.

Another feature of the present invention is the provision in a bassinet apparatus, of at least one flexible strap portion engaged between the first side support member and the bassinet receptacle and of at least one flexible strap portion engaged between the second side support member and the bassinet receptacle.

Another feature of the present invention is the provision in a bassinet apparatus, of each of the first and second bassinet support members including an intermediate section, where the intermediate sections oppose each other in a first direction, where each of the first and second side support members includes a width extending in the first direction, where such width may be slightly less than the first distance such that when the first and second side support members are pivoted the first and second side support members are pivotable so as to fit between the intermediate sections, where such width may be generally equal to such first distance, or where such width may be at least slightly more than such distance such that the when the first and second side support members are pivoted the first and second side support members may abut or hit the intermediate sections instead of pivot between them such that the intermediate sections work as a stop against the first and second side support members pivoting through the plane defined by the intermediate sections.

Another feature of the present invention is the provision in a bassinet apparatus, of the first bassinet support member including opposite end portions that are spaced apart by a first distance, where the second bassinet support member includes opposite end portions that are spaced apart by said first distance, where the opposite end portions engage sides of the side support members, and where inner ends of the side support members are spaced from each other and adjacent to each other when in an unlocked position and pivoted to an innermost position.

Another feature of the present invention is the provision in a bassinet apparatus, of a flexible strap having proximal and distal ends, where the proximal end of the flexible strap is engaged to the base, and of a distal end counter member engaged to the distal end of the flexible strap, where the distal end counter member includes first and second pieces extending at a right angle relative to each other and being rigid relative to each other.

Another feature of the present invention is the provision in a bassinet apparatus, of at least one proximal end counter member on the base, where the proximal end counter member includes a rigid piece pivotable between horizontal and vertical positions.

Another feature of the present invention is the provision in a bassinet apparatus, of the base including a) at least one leg depending from the first elongate support member and at least one leg depending from the second elongate support member; and b) at least one traversing support member engaged between the legs that holds the legs in a spaced apart relation such that the first and second elongate support members are held in a spaced apart relation.

Another feature of the present invention is the provision in a bassinet apparatus, of the base being a rocking base.

Another feature of the present invention is the provision in a bassinet apparatus, of the first elongate support member including a length greater than a length of the first side support member such that ends of the first elongate support member extend beyond sides of the first side support member, and of the second elongate support member including a length greater than a length of the second side support member such that ends of the second elongate support member extend beyond sides of the second side support member.

Another feature of the present invention is the provision in a bassinet apparatus, of each of the first and second side support members including a piece having an outer perimeter and an opening, where the opening is a through opening, where the opening is defined by an inner edge, where the outer perimeter is spaced from the inner edge, and where the outer perimeter and inner edge have an identical shape.

Another feature of the present invention is the provision in a bassinet apparatus, of each of the outer perimeter and inner edge defining a trapezoidal shape.

Another feature of the present invention is the provision in a bassinet apparatus, of each of the first and second side support members including a piece having an outer perimeter, where the outer perimeter defines a trapezoidal shape.

Another feature of the present invention is the provision in a bassinet apparatus, of a bassinet receptacle having first and second opposing sides, first and second opposing ends, and a floor, where a direction running from the first opposing side to the second opposing side defines a first direction.

Another feature of the present invention is the provision in a bassinet apparatus, of first and second bassinet support members, where the first and second bassinet support members engage the bassinet receptacle, and where the bassinet receptacle depends from the first and second bassinet support members.

Another feature of the present invention is the provision in a bassinet apparatus, of first and second side support members, where the first side support member is pivotally engaged to each of the first and second bassinet support members such that the first side support member pivots about an axis parallel to the first direction, where the second side support member is pivotally engaged to each of the first and second bassinet support members such that the second side support member pivots about an axis parallel to the first direction.

Another feature of the present invention is the provision in a bassinet apparatus, of a first flexible strap portion engaged between the first side support member and the bassinet and a second flexible strap portion engaged between the second side support member and the bassinet.

Another feature of the present invention is the provision in a bassinet apparatus, of a base including a) first and second elongate support members spaced apart from each other and parallel to each other, b) the first side support member slideably engaging the first elongate support member and the second side support member slideably engaging the second elongate support member, c) the first elongate support member including a length greater than a length of the first side support member such that ends of the first elongate support member extend beyond sides of the first side support member, and the second elongate support member including a length greater than a length of the second side support member such that ends of the second elongate support member extend beyond sides of the second side support member, and d) the base having a first location and a second location, the base being adjustable such that a distance between the first and second location is adjustable.

Another feature of the present invention is the provision in a bassinet apparatus, of a base including a) first and second elongate support members spaced apart from each other and parallel to each other, b) the first side support member slideably engaging the first elongate support member and the second side support member slideably engaging the second elongate support member, c) the first elongate support member including a length greater than a length of the first side support member such that ends of the first elongate support member extend beyond sides of the first side support member, and the second elongate support member including a length greater than a length of the second side support member such that ends of the second elongate support member extend beyond sides of the second side support member, d) at least one leg, and e) at least one rocker engaged to the at least one leg.

An advantage of the present invention is that the bassinet apparatus is a safe place for the infant or baby to sleep or rest.

Another advantage of the present invention is that the bassinet apparatus may fold to a flat form for initial shipping, retail shelves, and storage at home.

Another advantage of the present invention is that the bassinet apparatus easily converts from the flat stored form to the upright operating form.

Another advantage of the present invention is that the bassinet apparatus may be slideably engaged onto a first base and then slideably engaged onto a second base.

Another advantage of the present invention is that the bassinet apparatus may be easily slideable on and off the first base.

Another advantage of the present invention is that the bassinet apparatus may be easily slideable on and off the second base.

Another advantage of the present invention is that the first base is conveniently engagable to a bed.

Another advantage of the present invention is that the second base is conveniently portable such that the bassinet apparatus, including the second base, may be easily carried by the caregiver from place to place in the home.

Another advantage of the present invention is that the bassinet apparatus is inexpensive to manufacture.

Another advantage of the present invention is the bassinet apparatus is simple to assemble, operate, and disassemble.

DESCRIPTION

Figure 1:
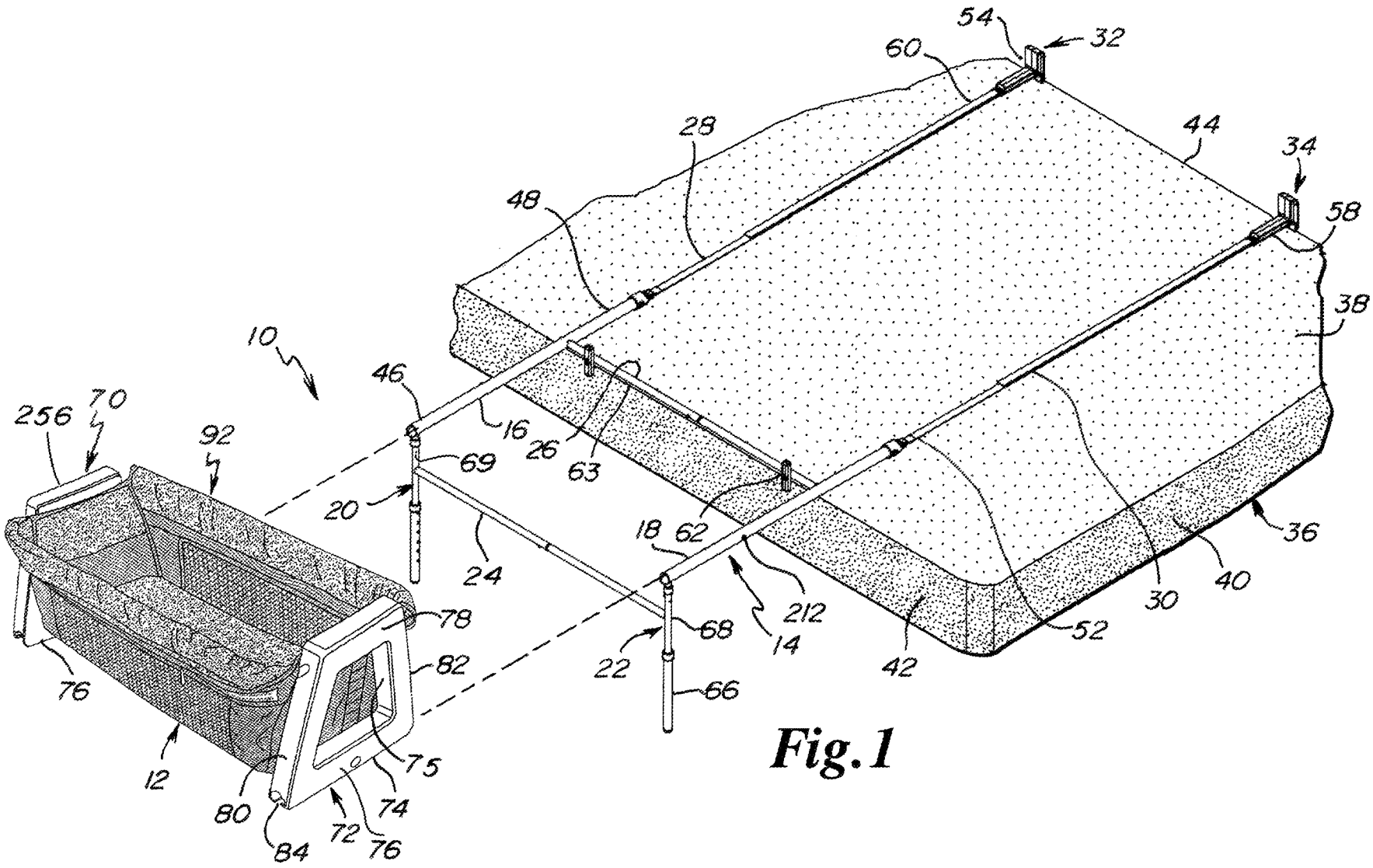
FIG. 1 is a perspective view of a body of the present bassinet apparatus about to be engaged to a base of the present bassinet apparatus, where the base is engaged to a mattress support.

As shown in FIG. 1, the present bassinet apparatus 10 includes a body 12 and a base 14. The base 14 includes first and second elongate support members 16, 18, first and second legs 20, 22, a leg cross support member 24, and an elongate support cross support member 26. The base 14 further includes first and second flexible and adjustable straps 28, 30 and first and second distal counter members 32, 34. Mattress support 36 includes an upper surface 38, a head end 40, a proximal side 42, and a distal side 44.

Figure 2:
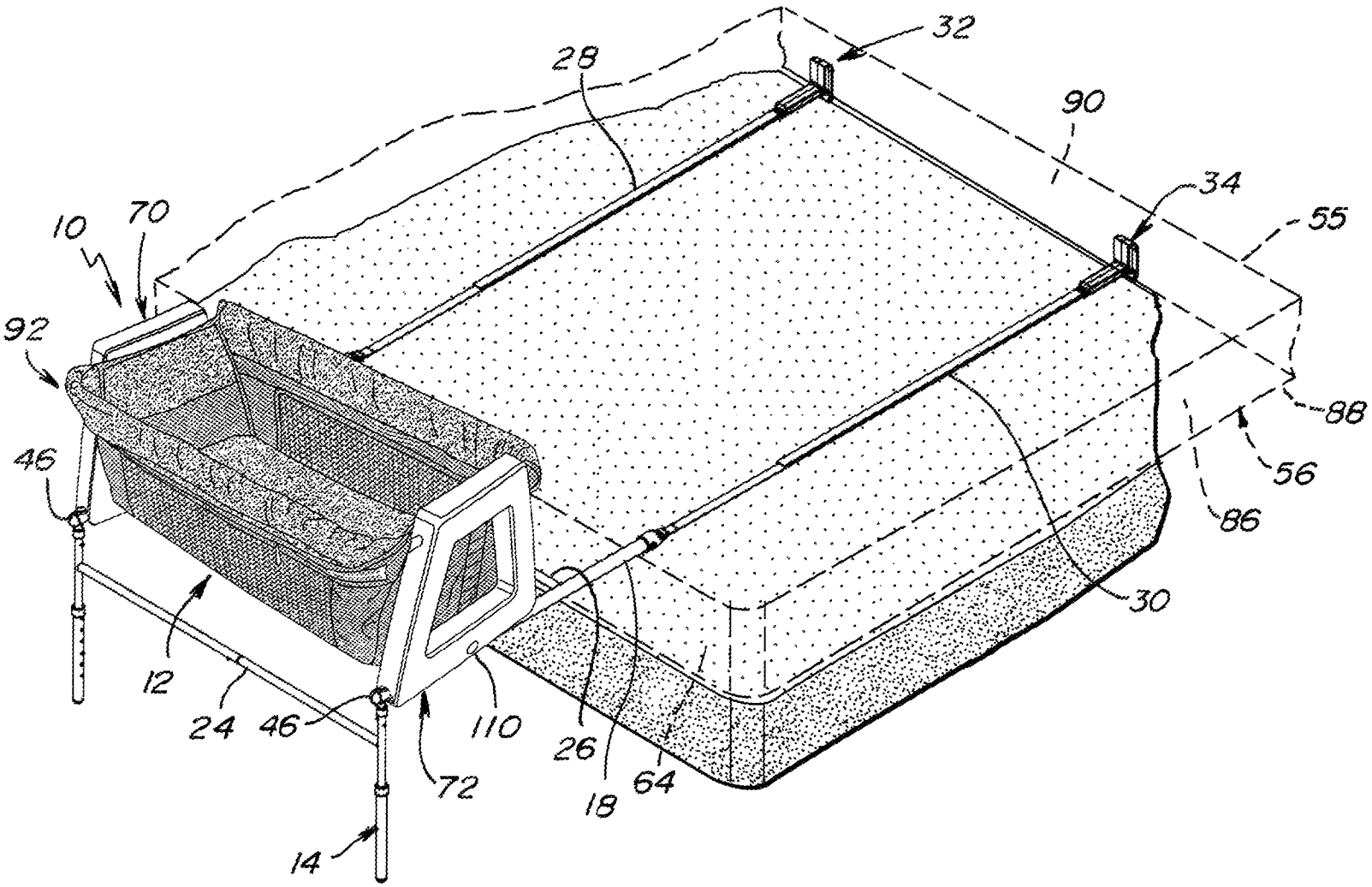
FIG. 2 is a perspective view of the body of the present bassinet apparatus of FIG. 1 engaged to the base of the present bassinet apparatus of FIG. 1 that is in turn engaged to a bed, where the bed includes the mattress support of FIG. 1 and a mattress that is shown in phantom on the mattress support, and where this view shows use of the present bassinet apparatus during, for example, night time hours.

Each of the elongate support members 16, 18 is a metal tube. Each of the elongate support members 16, 18 includes a proximal end 46, a distal end 48, and a first spring biased button 212 extending from an outer side opening intermediate the proximal and distal ends 46, 48. Elongate support members 16, 18 run parallel to each other and define a plane. Each of the distal ends 48 of the elongate support members 16, 18 engages a proximal end 52 of one of the flexible straps 28, 30 in a nonadjustable manner. Each of the flexible straps 28, 30 includes adjustment buckles such that the length of each of the flexible straps 28 is adjustable to another length and then fixable at such second length. Each of the counter members 32, 34 includes a vertical piece 54 that confronts distal side 44 of mattress support 36 and that further confronts distal side 55 of a mattress 56 that is shown in FIG. 2. Each of the counter members 32, 34 further includes a horizontal piece 58 that is engaged to a distal end 60 of each of the flexible straps 28, 30. Horizontal piece or portion 58 is disposed at a right angle relative to vertical piece or portion 54 of the counter members 32, 34. Horizontal piece 58 is disposed between the upper surface of the mattress support 36 and the lower surface of the mattress 56.

Upper cross member 26 is engaged to and between the elongate support members 16, 18. Upper cross member 26 is coplanar with the elongate support members 16, 18 and is further coplanar with the proximal side 42 of mattress support 36. Upper cross member 26 includes a pair of pivoting proximal counter members or pieces 62 that are pivotally engaged to the upper cross member 26. When vertically disposed, a lower portion of proximal counter member 62 confronts proximal side 42 of mattress support 36. When vertically disposed, an upper portion of proximal counter member 62 confronts proximal side 64 of mattress 56. Proximal counter members 62 on the one hand and distal counter members 32, 34 on the other hand hug each of the mattress support 36 and mattress 56 therebetween, thereby fixing the base 14 at one location.

Figure 6A:
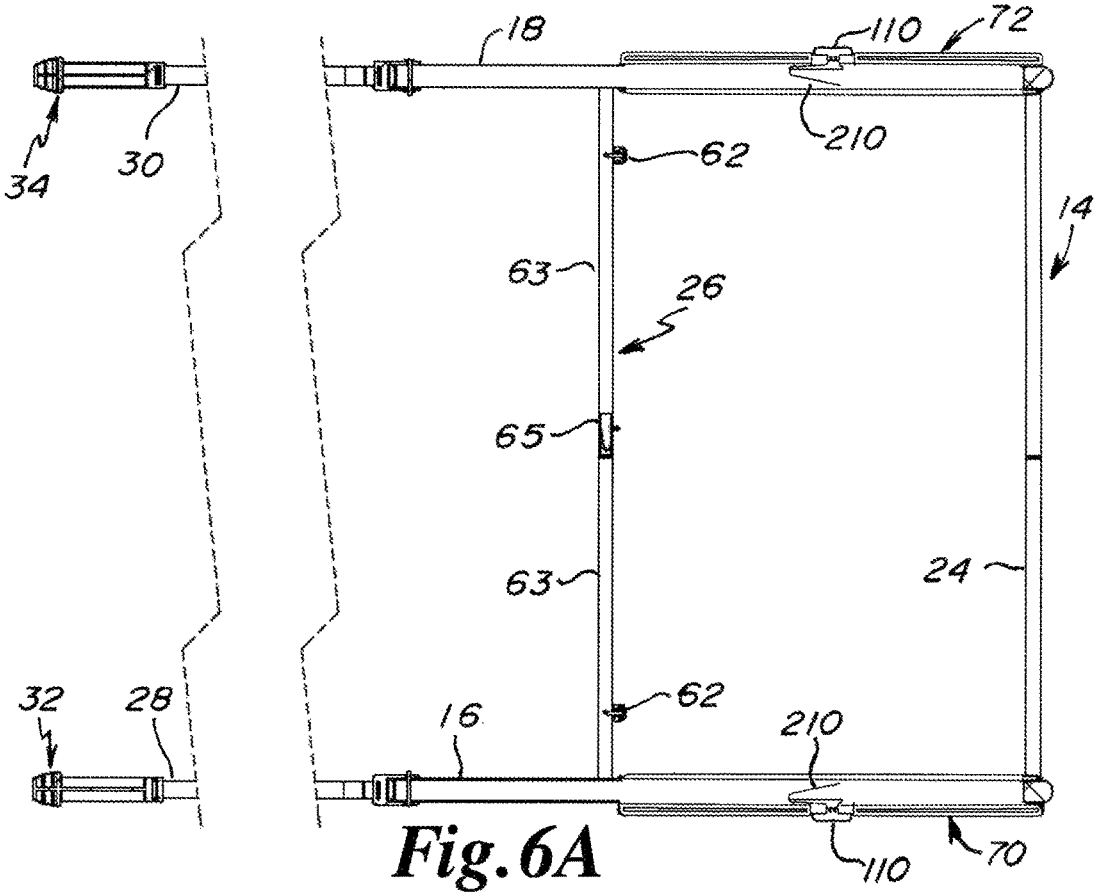
FIG. 6A is a top, partially cut way and partially section view of the body and base of the bassinet apparatus of FIG. 2, and shows a locking arrangement of the base relative to first and second side support members of the body of the bassinet apparatus.

As shown in FIGS. 1 and 6A, upper cross member 26 includes two straight half portions or tubes 63. The inner ends of these half portions 63 of the upper cross member 26 may slidingly engage each other. One inner end telescopes within the other inner end. Such inner ends may engage each other by a quick connect 65 shown in FIG. 6A. The quick connection 65 may include a spring biased button extending from an opening in one inner end to and through an opening in the other inner end. Depression of such button permits such inner ends to disengage from each other such that straight half portions 63 can be engaged and disengaged from each other. The outer end of one straight half portion 63 is welded to elongate support member 16. The outer end of the other straight half portion 63 is welded to elongate support member 16. Elongate support member 16 and its straight half portion 63 form a T-shape. This T-shaped piece is one-piece and integral. Elongate support member 18 and its straight half portion 63 form a T-shape. This T-shaped piece is one-piece and integral.

Legs 20, 22 are telescoping legs that are adjustable in height. Each of the legs 20, 22 includes a lower leg portion 66 and an upper leg portion 68. A spring biased button in the upper leg portion 68 is biased outwardly through an opening in the upper leg portion 68 to engage one of a set of lower leg openings formed in the lower leg portion 66. Depressing such button to be out of engagement with the lower leg portion 66 permits the lower leg portion 66 to slide relative to the upper leg portion 68 such that the legs 20, 22 are adjustable in height.

FIG. 1 shows that to prevent scratching during assembly or use a) each of the elongate support members 16, 18 has a proximal end 46 with a spherical or rounded plastic cap or visual indicator, which visual indicators let the user know that the side support members 70, 72 are in position, which position is when button 110 or visual and audio indicator 110 has popped out under pressure from button 212, b) the bottom ends of lower leg portions 66 have ends with spherical or rounded plastic caps that rest upon the floor when the base 14 is in use, and c) lower leg portions 66 have cylindrical end caps having openings to receive upper leg portions 68, where such cylindrical end caps have an annular end portion with an inside diameter equal to the inside diameter of lower leg portion 66 such that the upper terminal annular edge of lower leg portion 66 is covered with such annular end portion of such cylindrical end cap, and where the reminder of such cylindrical end cap has an inside diameter equal to the outside diameter of the lower leg portion 66.

Lower cross member 24 is engaged to and between upper leg portions 68 and is disposed in a plane defined by the legs 20, 22. The outer ends of lower cross member 24 are preferably rigidly and permanently engaged, such as by welding, to upper leg portions 68. The inner ends of lower cross member 24 may be readily engaged and disengaged from each other by a quick connection such as quick connect 65 between half portions 63. For example, the inner end of the portion of the lower cross member 24 welded to leg 20 may slidingly engage the inner end of the portion of the lower cross member 24 welded to leg 22. Such inner ends may engage each other by a spring biased button extending from an opening in one inner end to and through an opening in the other inner end. Depression of such button permits such inner ends to disengage from each other. One half portion of lower cross member 24 and upper leg portion 68 of leg 20 form a T-shape. This T-shape piece is one-piece and integral. The other half portion of lower cross member 24 and upper leg portion 68 of leg 22 form a T-shape. This T-shape portion is one-piece and integral.

One of the upper leg portions 68 is engaged to the proximal end 46 of elongate support member 16 by a downwardly extending tubular portion extending downwardly from proximal end 46 of elongate support member 16. The other of the upper leg portions 68 is engaged to proximal end 46 of elongate support member 18 by a downwardly extending tubular portion extending downwardly from proximal end 46 of elongate support member 18. In each of such downwardly extending tubular portions a spring biased button 69 resides that extends through a button opening in such downwardly extending tubular portion. From such button opening, the spring biased button 69 engages a button opening in the upper leg portion 68 such that the upper leg portions 68 can be engaged and disengaged from the elongate support members 16, 18. The downwardly extending tubular portions extend into upper open ends of the upper leg portions 68. This connection between the elongate support members 16, 18 and the upper leg portions 68 may be referred to as a quick connection.

Body 12 of bassinet apparatus 10 includes first and second side support members 70, 72. Each of the first and second side support members 70, 72 includes a trapezoidal shape. An outer perimeter 74 of each of the side support members 70, 72 is trapezoidal in shape. An inner perimeter 75 of each of the side support members 70, 72 is trapezoidal in shape. Each of the first and second side support members 70, 72 includes a bottom housing portion 76, a top housing portion 78, a first side housing portion 80, and a second side housing portion 82. Bottom and top housing portions 76, 78 run parallel to each other. Side housing portions 80, 82 are oblique relative to the bottom and top housing portions 76, 78. In combination, the bottom, top, first side, and second side housing portions 76, 78, 80, 82 form a trapezoidal shape. Top housing portion 78 may be utilized as a handle for carrying the bassinet body 12. The housing portions 76, 78, 80, and 82 may have different lengths but the housing portions 76, 78, 80, and 82 have generally the same width or the same circumference, which circumference is rectangular or square. Each of the first and second side support members 70, 72 includes first and second half members or housing portions also having this outer perimeter 74, where this outer perimeter defines a trapezoidal shape with each of the first and second half members or housing portions. If desired, the outer and/or inner perimeters 74, 75 may define a different shape, such as a rectangular shape having unequal adjacent sides, a square shape, a circular shape, a triangular shape, a pentagonal shape, a hexagonal shape, a shape having three, four, five, six, seven, eight, nine or ten or more sides, or an irregular shape. The first and second side support members 70, 72 may or may not have an opening and thus may or may not have an inner perimeter.

Figure 4A:
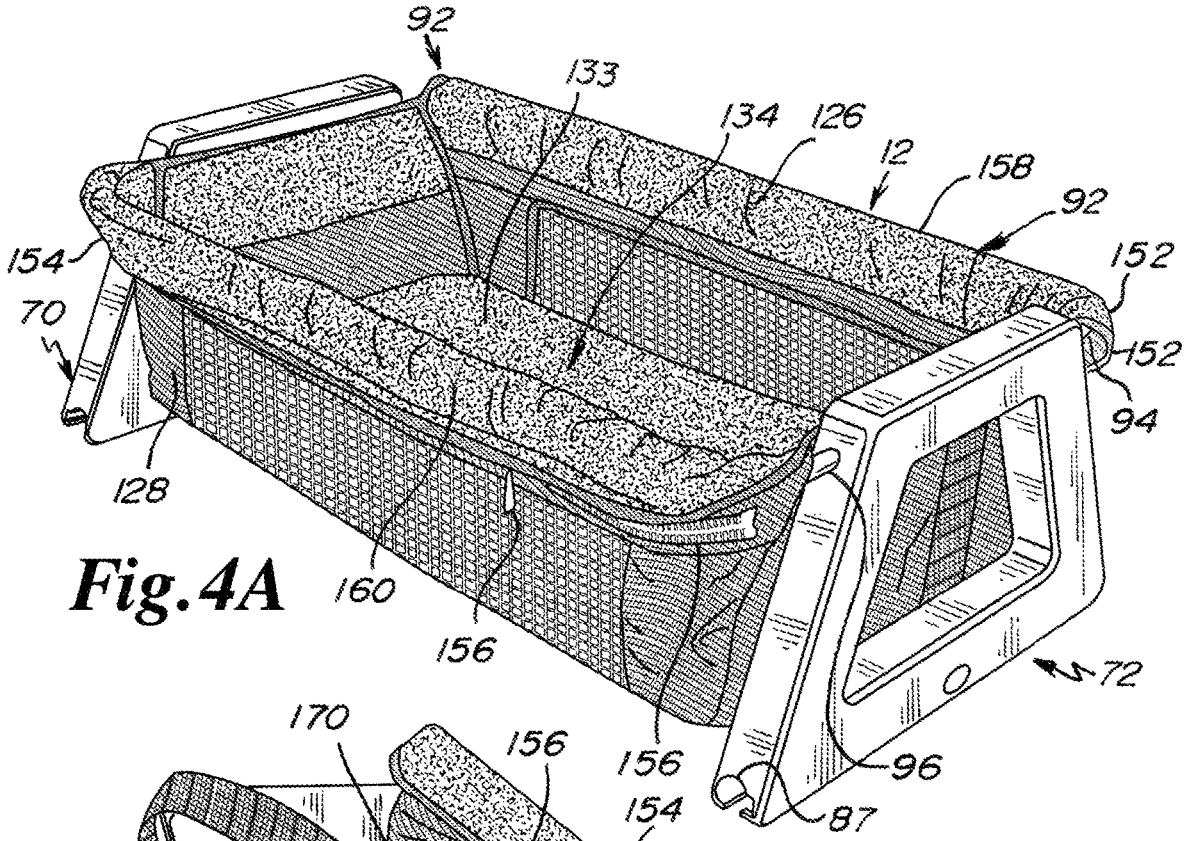
FIG. 4A is a top perspective view of the body of the bassinet apparatus of FIG. 3B in the folded out and locked form of FIG. 3B.

The bottom housing portion 76 includes a receptor 84 that is open on both ends and that receives one of the elongate support members 16, 18. Receptor 84 includes an open bottom slot 85 that slidingly receives one of the upper leg portions 68 as the side support member 70 or 72 is slid onto the elongate support member 16 or 18, as shown in FIG. 2. Receptor 84 extends from end to end of the bottom housing portion 76. Each of the end openings 87 of receptor 84 is keyhole shaped, as shown in FIG. 4A, so as to permit passage of the first button 212. After button 212 is allowed in by opening 87, button 212 is depressed by a track 260, shown in FIG. 12A, so as to compress spring 210 until the first button 212 pops out audibly into the T-shaped opening 216 and pushes out the second button 110. The rectangular portion of the opening 87 for button 212 is formed on the side of the bottom housing portion 76 where second button 110 is disposed.

FIG. 2 further shows that the side support members 70, 72 are slid fully onto the elongate support members 16, 18 until the proximal ends 46 of the elongate support members 16, 18 have been slid beyond the ends of bottom housing portions 76.

FIG. 2 further shows mattress 56. Mattress 56 includes distal side 55, proximal side 64, a head end 86, a lower surface 88, and a sleeping surface 90. The mattress 56 is shown in phantom. The lower surface 88 of mattress 56 confronts the upper surface 38 of the mattress support 36. Elongate support members 16 and 18 are sandwiched between the upper surface 38 of the mattress support 36 and the lower surface 88 of the mattress 56. Vertical portion 54 of counter members 32, 34 confront the distal side 55 of mattress 56 and the distal side 44 of mattress support 36. Vertical portions of proximal counter members 62 confront the proximal side 42 of the mattress support 36 and the proximal side 64 of the mattress 56.

With the proximal and distal counter members 62, 32, 34 engaged to the mattress support 36 and mattress 56, lateral movement of base 14 to and from the bed or mattress support 36 and mattress 56 is minimized. Longitudinal movement of the base 14 relative to the bed is also minimized because the flexibility of the straps 28, 30 prevents the distal counter members 32, 34 from moving in unison with any longitudinal movement applied to the base 14. Hence, an attempted movement of the base 14 to the head ends 40, 86 of the mattress support 36 and mattress 56 tightens rather than loosens strap 28 since the length of the elongate support member 16 and strap 28 stays the same but the attempted path of elongate support member 16 and strap 28 is greater: the attempted path defines the hypotenuse of a right triangle, where the proximal sides 42, 64 define one side of the right triangle and the original position of the elongate support member 16 and strap 28 defines the other side of the right triangle. Base 14 is thereby fixed in place and the body 12 is also fixed in place on the elongate support members 16, 18 through a locking arrangement disposed in the bottom housing portion 76 such that the base 14 is fixed in place immediately by the bed where one or more caregivers sleep.

Figure 8:
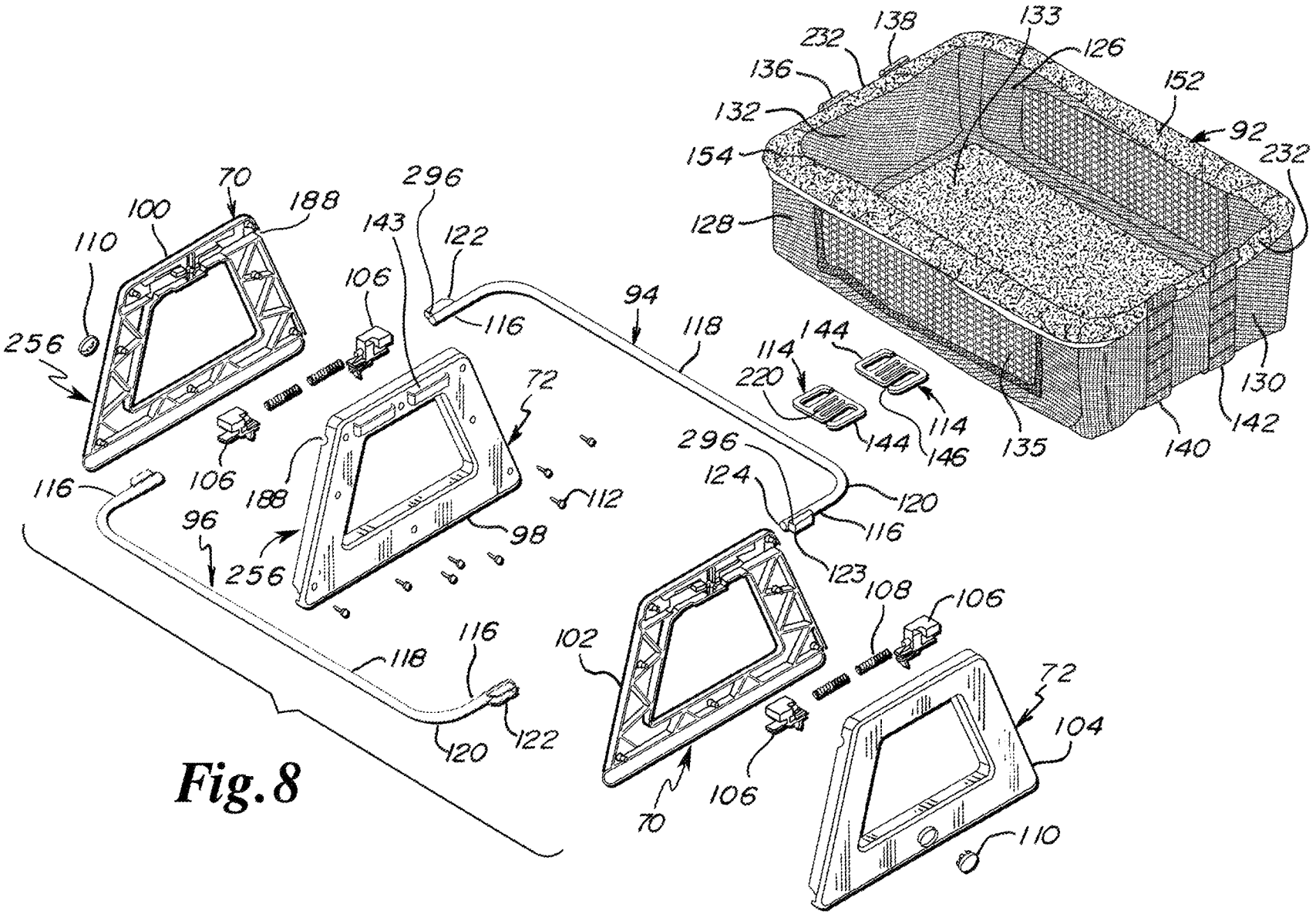
FIG. 8 is an exploded perspective view of the body of the bassinet apparatus of FIG. 1.

FIG. 8 is an exploded perspective view of the base 14. Base 14 includes a flexible bassinet soft receptacle 92, first and second bassinet support members 94, 96, inner housing portion 98 of first side support member 70, outer housing portion 100 of first side support member 70, inner housing portion 102 of second side support member 72, outer housing portion 104 of second side support member 72, trigger blocks or pieces 106, coil springs 108, push buttons 110, pin connectors 112 for engaging housing portions 98, 100 together and for engaging housing portions 102, 104 together, and buckles 114.

Each of the first and second bassinet support members 94, 96 may be tubular if desired. Each of the first and second bassinet support members 94, 96 may be a rod and solid in section if desired.

Each of the first and second bassinet support members 94, 96 includes a pair of end portions 116 and a straight intermediate portion 118 between the end portions 116. The straight intermediate portion 118 extends at both ends into a curved corner portion 120 that in turn extends into one end portion 116.

Each of the end portions 116 includes an integral U-shaped portion 122 that extends outwardly. The opening of the U-shaped portion 122 opens toward its adjacent corner portion 120. The closed part of the U-shaped portion 122 is adjacent to a terminal end 124. When the end portion 116 is nested in the top housing portion 78, the integral U-shaped portion 122 extends toward outer portion 100 or outer portion 104. The integral U-shaped portion 122 includes an end 123 or face 123. End 124 of bassinet support members 94, 96 extends slightly beyond end or face 123.

End portions 116 on the first bassinet support member 94 run parallel to each other and at a right angle to the intermediate portion 118 on such support member 94. End portions 116 on the second bassinet support member 96 run parallel to each other and at a right angle to the intermediate portion 118 on such support member 96.

Bassinet receptacle 92 is receptacle shaped. Bassinet receptacle 92 includes a first flexible side 126, a second flexible side 128, a first flexible end 130, a second flexible end 132, and a floor 134 that includes flexible components and a hard component or board 162. Floor 134 is shown in FIG. 7B. Without hard component or board or peg board 162, bassinet receptacle 92 as a whole is flexible. First side 126 is engaged to ends 130, 132, and floor 134. Second side 128 is engaged to ends 130, 132, and floor 134. First end 130 is engaged to sides 126, 128, and floor 134. Second end 132 is engaged to sides 126, 128, and floor 134. Floor 134 is engaged to sides 126, 128 and ends 130, 132. Each of the first and second sides 126, 128 include a rectangular flexible piece of mesh 135 engaged therein. The bottom edge of mesh window 135 is disposed generally at the junction of the floor 134 and each respective side 126, 128. The top of the mesh window 135 is spaced from and spaced below the quick connect mechanism 156 engaged to each respective side 126, 128. The ends of the mesh window 135 are spaced from the ends 130, 132. Bassinet receptacle 92 further includes a resilient or soft or foam rectangular piece 133 of bedding that is engaged to the top of the upper surface of floor 134 and extends to be adjacent to sides 126, 128 and ends 130, 132. The lower surface of bedding piece 133 includes quick connect strips 137 and the upper surface of floor 134 includes quick connect strips 139 that engage quick connect strips 137 to engage the floor 134 and bedding piece 133. Such quick connect strips 137, 139 may be Velcro® strips having macroscopic hooks and loops.

Bassinet receptacle 92 includes a set of four flexible straps 136, 138, 140, 142. Proximal ends of the straps 136, 138, 140, 142 engage top edges of ends 130, 132 of the bassinet receptacle 92, then pass freely through a loop defined by a respective U-shaped bar 143 integrally engaged on the inside face of the top housing portions 78 of first and second side support members 70, 72, then continue freely down the outside faces of the ends 130, 132, then turn freely to the outside face of the floor 134 of the bassinet receptacle 92, then pass freely through loops formed by flexible strips 234, and then engage clips 144 of buckles 113 with distal loop ends 228. Distal loop ends 228 of the straps 136, 138, 140, 142 engage buckles 114 underneath floor 134 such that strap 136 engages one of the buckles 114 that in turn engages strap 140 and such that strap 138 engages the other of the buckles 114 that in turn engages strap 142. Straps 136, 138, 140, 142 thereby support the floor 134 of the bassinet receptacle 92, with the ends 130, 132 contributing to supporting the floor 134, and with the sides 126, 128 contributing to supporting the floor 134.

Each of the buckles 114 is S-shaped. Each of the buckles 114 includes a resilient clip 144 at each end. A clip 144 on one end has an opening 146 that is opposite of the opening 146 of the clip 144 on the other end. The distal loop end 228 of one of the straps 136, 138, 140, 142 is slid through opening 146 and then is engaged by the clip 144. Opening 146 is disposed at the end of the resilient clip 144 and confronts the body of buckle 114. The clip 144 resiliently gives and bends in a vertical fashion when body 12 is in an operative position to aid the distal loop end 228 being slid in or out of buckle 114. Clip 144 is rigid against pulling by distal loop end 228 when distal loop end 228 is pulled in an outer horizontal direction. Buckle 114 is a quick connect buckle. Proximal ends 230 of straps 136, 138, 140, 142 are permanently engaged, such as by stitching, to the top end edges 232 of end walls 130, 132.

Figure 3A:
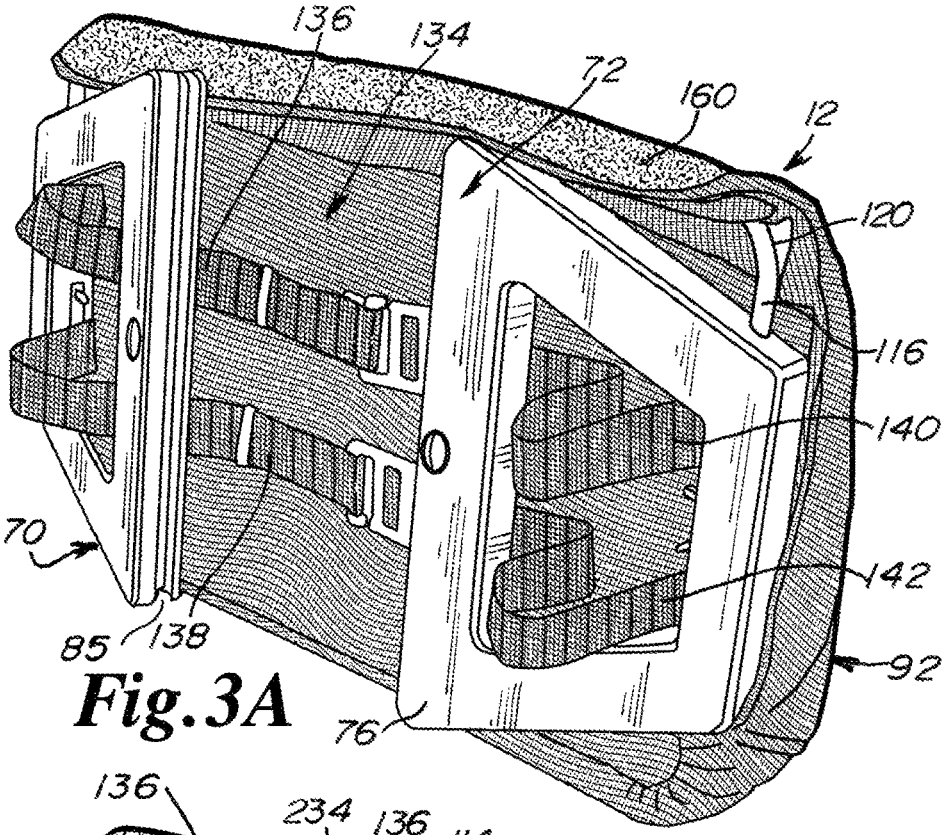
FIG. 3A is a bottom perspective view of the base of the bassinet apparatus of FIG. 1 folded into a generally flat form in which it may be shipped or stored.
Figure 3B:
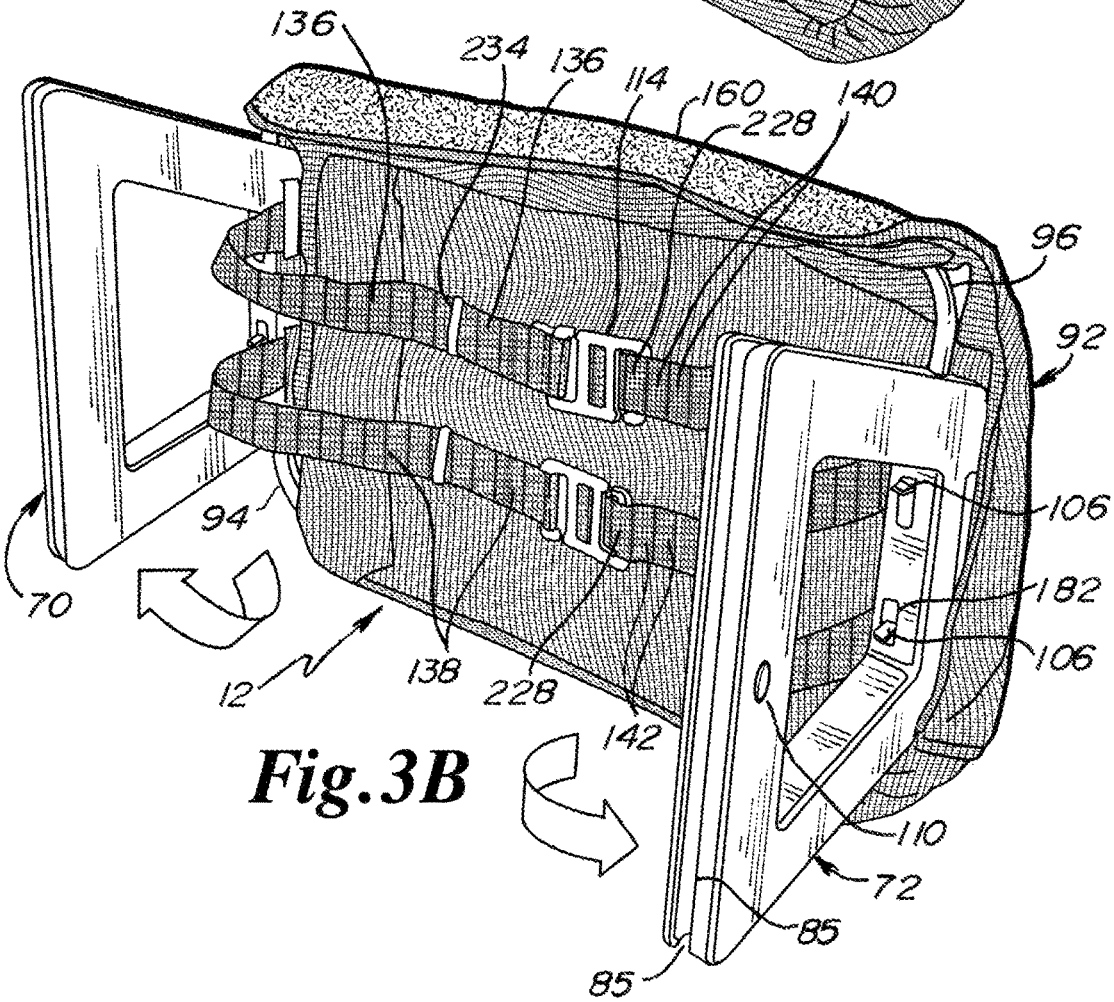
FIG. 3B is a bottom perspective view of the body of the bassinet apparatus of FIG. 3A and shows side support members having been folded out and locked from a generally flat form of the body of the bassinet apparatus of FIG. 3A.

FIGS. 3A and 3B in combination show that the first and second side support members 70, 72 are pivotally engaged to the first and second bassinet support members 94, 96. FIG. 3A shows the first and second side support members 70, 72 pivoted slightly away from a coplanar form with the first and second bassinet support members 94, 96. FIG. 3B shows the first and second side support members 70, 72 pivoted to a locked form, as shown by trigger blocks or pieces 106 having been urged apart by the coil springs 108.

FIG. 3A shows the compact form. In this form the junction of one of the side housing portions 80, 82 and the bottom housing portion 76 comes to rest upon side bassinet support member 94 and the junction of the other of the side housing portions 80, 82 and the bottom housing portion 76 comes to rest upon side bassinet support member 96. The point of abutment of such junction is between the outer and inner edges of each of the side bassinet support members 94, 96. This width between such junctions is desired to prevent the side support members 70, 72 from being rotated for 360 degrees about the bassinet support member ends 116. However, if desired, the length of the bottom housing portion 76 can be reduced less than an inch such that housing portions 70, 72 can pivot to a true planar form with the plane defined by bassinet support members 94, 96. In other words, if desired when manufactured, the first and second side support members 70, 72 define first and second planes, and each of these members 70, 72 can, when manufactured such that the length of bottom housing portion 76 is reduced less than an inch, pivot into a third plane defined by first and second bassinet support members 94, 96 such that these first, second, and third planes are coplanar such that body 12 defines a planar form in the compact form.

FIGS. 3A and 3B shows that the first and second side support members 70, 72 have been pivoted away from the planar form. FIG. 3A shows a slight pivot away from the planar form. FIG. 3B shows first and second side support members 70, 72 locked to the first and second bassinet support members 94, 96. Longer bottom housing portion 76 of the first and second side support members 70, 72 may, if desired, have a length less than a distance between the intermediate portions 118 of the first and second bassinet support members 94, 96. The bottom housing portion 76 is the longest or widest portion of the first and second side support members 70, 72. In the flat and compact form of FIG. 3A, the bottom housing portions 76 of the first and second side support members 70, 72 face each other and are adjacent to each other and spaced from each other.

FIG. 3B shows distal loop ends 228 for each of the flexible strap 136, 138, 140, 142. The distal loop ends 228 are formed by the terminal end of such strap being stitched back onto itself a short distance from such terminal end.

FIG. 4A shows a detail view of the body 12 with the bassinet receptacle 92 and first and second side support members 70, 72 in a locked position relative to the first and second bassinet support members 94, 96. The floor 134 of the bassinet receptacle 92 defines a plane that is disposed at a higher elevation than a plane defined by where the undersides of the bottom housing portions 76 of the first and second side support members 70, 72 meet a surface such as a table, when the bassinet receptacle 92 is empty and is holding no infant or baby. As shown in FIG. 5C, such undersides of the bottom housing portions 76 may not rest flat upon the surface of a table. When weight, such as a baby, is placed in bassinet receptacle 92 and on floor 134, the floor 134 may bend or curve or flex and the bottom of the floor 134 may rest slightly upon such a surface, such as the surface of a table. It should be noted that the top faces of the top housing portions 78 are disposed above a plane defined by the first and second bassinet support members 94, 96.

Figure 4B:
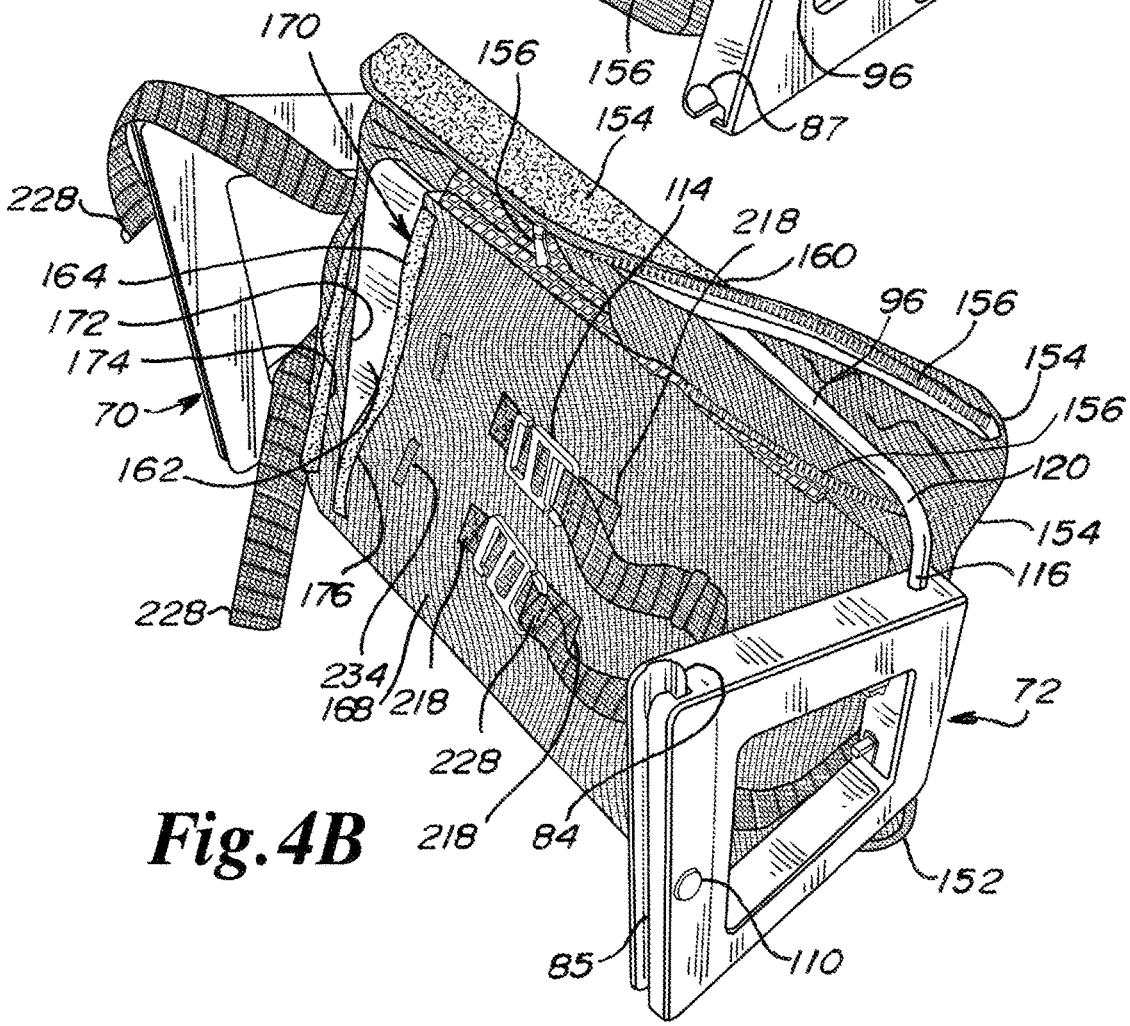
FIG. 4B shows a bottom perspective view of the body of the bassinet apparatus of FIG. 4A and shows a soft portion of the body of the bassinet apparatus being disengaged from a hard portion of the body of the bassinet apparatus.

As further shown in FIGS. 4A and 4B, a pair of first and second side flexible extensions 152, 154 extend outwardly from first and second receptacle sides 126, 128 to wrap over first and second bassinet support members 94, 96, about first and second bassinet support members 94, 96, and downwardly from first and second bassinet support members 94, 96, whereupon bottom edges of the first and second side flexible extensions 152, 154 are engaged by a quick connect 156 to the outer faces of the first and second receptacle sides 126, 128. In this case, the quick connect 156 is a zipper mechanism having one set of zipper teeth engaged to a respective bottom edge, or tucked away inside and upwardly from such bottom edge, of one of the first and second side flexible extensions 152, 154 and another set of zipper teeth engaged to the outer face of such first or second side flexible extension 152 or 154. Side extension 152 and side 126 in combination form a horizontal passageway or horizontal receptor 158 for first bassinet support member 94. Side extension 154 and side 128 in combination form a horizontal passageway or horizontal receptor 160 for second bassinet support member 96. Horizontal receptors 158, 160 in combination with flexible straps 136, 138, 140, 142 engage the bassinet receptacle 92 to the first and second bassinet support members 94, 96 and first and second side support members 70, 72. First and second bassinet support members 94, 96, the first and second side support members 70, 72, and board or peg board 162 are the frame components or hard components of the body 12 while the bassinet receptacle 92, including the sides 126, 128, ends 130, 132, floor 134 (when employed without board 162), and mesh 135 are the soft components of the body 12. Board 162 is preferably employed with bassinet receptacle 92. Each of the quick connections or zippers 156 essentially runs from one end 130 to the other end 132 of bassinet receptacle 92 along the respective side 126, 128 of the bassinet receptacle 92 that such quick connection or zipper 156 engages. Each of the quick connections or zippers 156 disengages or unzips completely from its respective side 126, 128 of the bassinet receptacle 92.

As shown in FIG. 4B, a hard component of the body 12 is a rigid or hard, rectangular shaped floor portion 162, such as a peg board, that is engaged in a pocket 164. Pocket 164 is formed in the floor 134 of the bassinet receptacle 92 by an upper rectangular shaped floor layer 166 and a lower rectangular shaped floor layer 168. Upper rectangular shaped floor layer 166 is shown in FIG. 7B. Floor 134 may be one or more of bedding 133, upper layer 166 of pocket 164, lower layer 168 of pocket 164, and hard floor portion 162. The portions of floor 134 that are engaged to the sides 126, 128 and ends 130, 132 are the upper and lower layers 166, 168. Pocket 162 has a single opening 170 formed at or near an end junction of the upper and lower layers 166, 168. A flap extension 172 extending from one of the layers 166, 168 includes a strip 174 of quick connect material on the upper or inner surface of the flap extension 172. The strip 174 of quick connect material engages a strip 176 of quick connect material engaged on the lower or outer surface of the lower layer 168. Strips 174, 176 run perpendicular to the direction of the intermediate section 118 of the bassinet support members 94, 96. Strips 174, 176 run generally the length of the opening 170. Strips 174, 176 may include a quick connect material such as Velcro®, which includes macroscopic hooks and loops for connection. Opening 170 is accessible from the underside of the bassinet receptacle 92. Pocket 164 and board 162 are generally the same size to include generally the same width, length, and height. Pocket 164 and board 162 generally extend the width of the floor 134, i.e., from first side 126 to second side 128 of the bassinet receptacle 92. Pocket 164 and board 162 generally extend the length of the floor 134, i.e., from first end 130 to second end 132 of the bassinet receptacle 92. Board 162 includes a width defined by the direction from bassinet support member 94 to bassinet support member 96. The width of board 162 is less than the width between intermediate portions 118 of bassinet support members 94, 96.

Figure 5A:
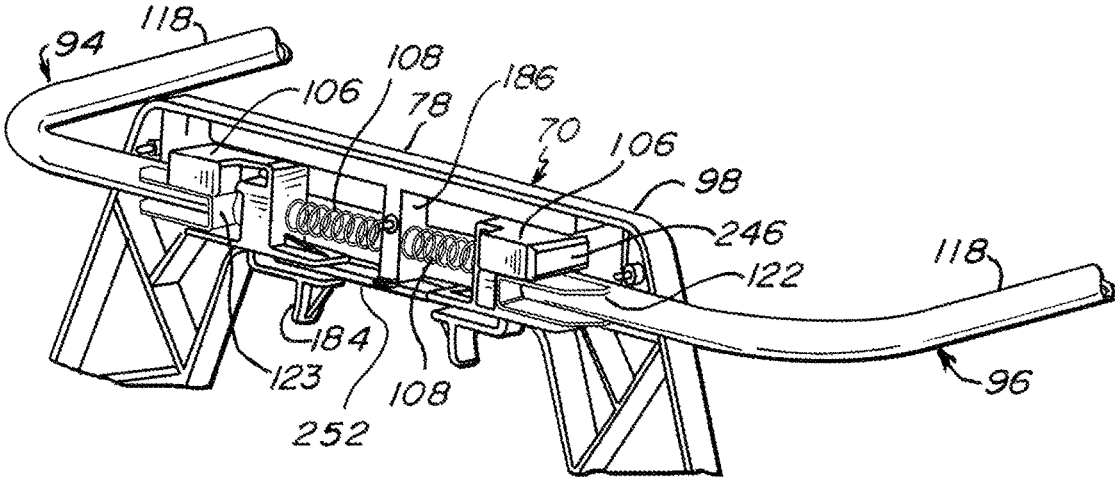
FIG. 5A is a perspective partial view of the body of the bassinet apparatus of FIG. 1, and schematically shows a locking arrangement of a side support member relative to first and second bassinet support members, where the side support member is locked relative to the first and second bassinet support members.
Figure 5B:
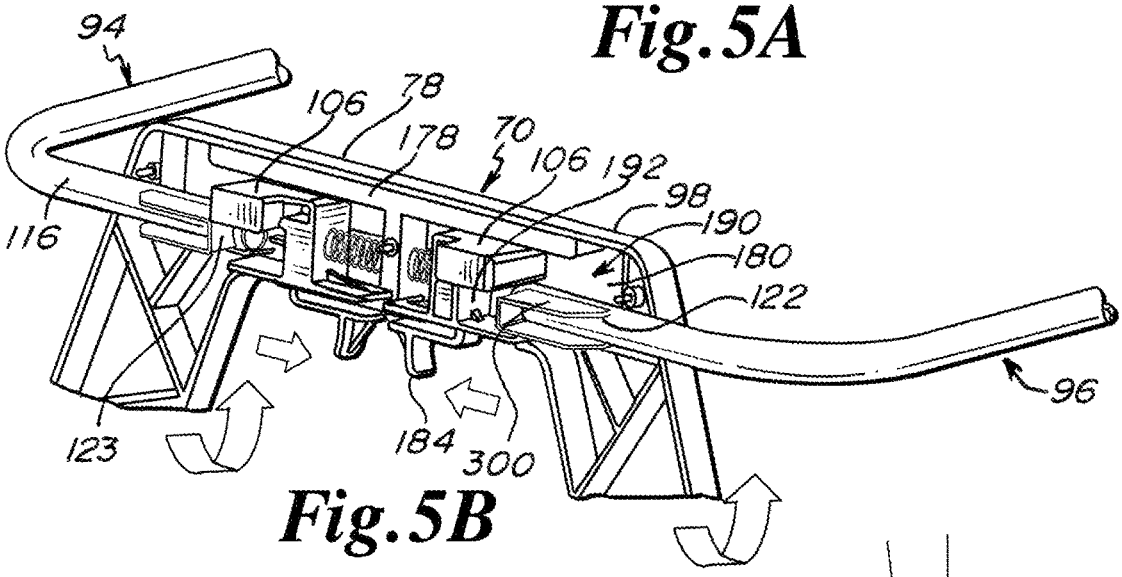
FIG. 5B is a perspective partial view of the body of the bassinet apparatus of FIG. 1, and schematically shows the locking arrangement of FIG. 5A in an unlocked position such that the side support member can pivot relative to the first and second bassinet support members.
Figure 5C:
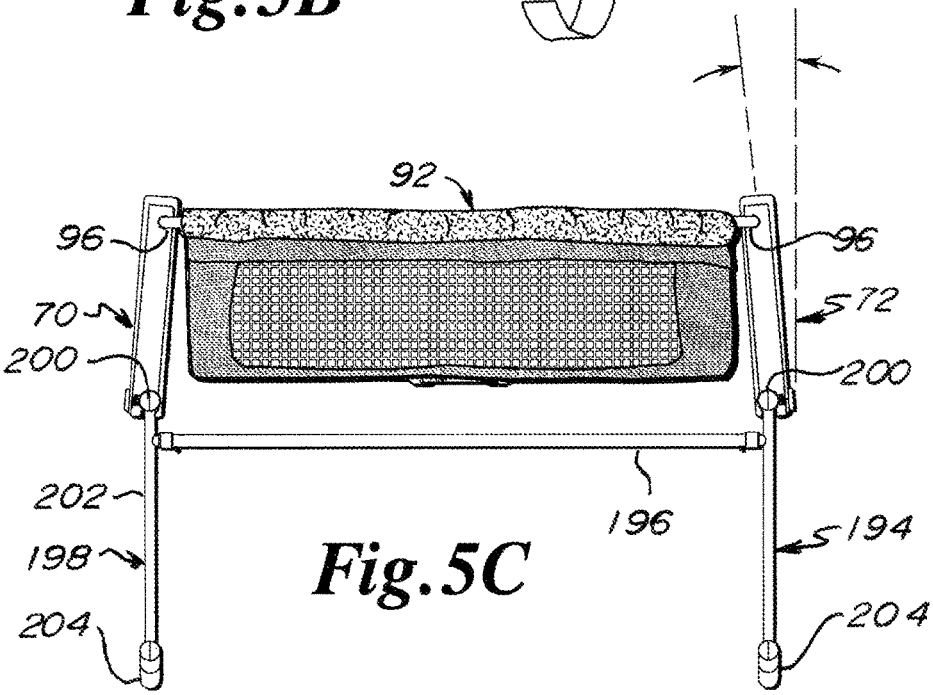
FIG. 5C is a side elevation view of the body of the bassinet apparatus of FIG. 1 and shows an alternate embodiment of the base, where the base is a rocker base.

FIGS. 5A and 5B show how the bassinet support members 94, 96 pivot and lock relative to the side support members 70, 72. Each of the side support members 70, 72 includes half portions. Side support member 70 includes the inner trapezoidal half portion 98 and the outer trapezoidal half portion 100. When secured together with pins 112, half portions 98, 100 slidingly engage therein trigger blocks or pieces 106. Each of the half portions 98, 100 includes an elongate inner housing portion 178 that slidingly engages trigger blocks 106 from above. The upper face of the bottoms of the top housing portion 78 slidingly engages trigger blocks 106 from below.

Each of the inner half portions 98, 102 includes an outer wall housing portion 180 that relatively slidingly engages trigger blocks or pieces 106 on one of the sides of the trigger blocks or pieces 106. Each of the outer half portions 100, 104 includes an outer wall housing portion 264 that relatively slidingly engages trigger blocks or pieces 106 on the other of the sides of the trigger blocks or pieces 106.

The bottom of the top housing portion 78 includes a pair of openings 182, shown in FIG. 3B, that receive triggers 184 of the trigger blocks 106. Triggers 184 are one-piece and integral with trigger blocks 106. An internal vertical wall 186 depends from housing portion 178. Coil spring 108 is engaged between the internal vertical wall 186 and one of the trigger blocks 106. The end portions 116 of the bassinet support members 94, 96 are engaged in the side support members 70, 72 by side support housing portions such as opening 188, shown in FIG. 8. Side support members 70, 72 include open areas 190 therein for receiving the U-shaped portion 122 of bassinet support member end portion 116 when the trigger blocks 106 are slidingly pulled together and away from the bassinet support member end portions 116. Trigger block 106 includes an opening or receptor 192 for receiving and engaging the U-shaped portion 122 of the bassinet support member end portions 116. As shown by FIG. 5A, when the U-shaped portion 122 is engaged by the receptor 192 of the trigger block 106, the side support members 70, 72 are locked relative to the bassinet support members 94, 96 and, at this point in time, the coil springs 108 are extended or expanded to their greatest length. As shown by FIG. 5B, when the triggers 184 are squeezed to confront each other, the trigger blocks 106 slide toward each other and the coil springs 108 are retracted or compressed to their shortest length such that the open areas 190 can pivot to receive the U-shaped portions 122. Side support member 70 or 72 is pivoting and, since open area 190 is part of side support member 70 or 72, such pivoting brings the open area 190 about the U-shaped portion 122 to where end face 123 of the U-shaped portion 122 lies cross-wise to the end face 246 of the trigger block 106. In other words, FIG. 5B shows nothing occupying an upper portion of open area 190, but such upper portion of open area 190 may be occupied 1) by a portion of the trigger block 106 (when the side support members 70, 72 are locked to the bassinet support members 94, 96, shown in FIG. 5A), 2) by nothing (an intermediate step shown by FIG. 5B where the triggers 184 are fully squeezed and the pivoting of the side support members 70, 72 can be implemented), and 3) by the U-shaped portion 122 (when the side support members 70, 72 and bassinet support members 94, 96 are coplanar and where face 123 of the U-shaped portion 122 lies cross-wise to the end face 246 of the trigger block 106).

FIG. 5C shows the preferred orientation of the first and second side support members 70, 72 relative each other. Here each of the first and second side support members 70, 72 define a plane and the planes lie not parallel to each other but obliquely toward each other.

FIG. 5C shows the preferred orientation of the first side support member 70 relative to a first plane defined by one or more of bassinet support member 94, bassinet support member 96, and bassinet support members 94, 96 as a whole. Here the first side support member 70 defines a second plane and such second plane is disposed not at a right angle to the first plane but at an oblique angle relative to the first plane.

FIG. 5C shows the preferred orientation of the second side support member 72 relative to a first plane defined by one or more of bassinet support member 94, bassinet support member 96, and bassinet support members 94, 96 as a whole. Here the second side support member 72 defines a second plane and such second plane is disposed not at a right angle to the first plane but at an oblique angle relative to the first plane.

FIG. 5C shows the preferred orientation of the first and second side support members 70, 72 relative to a vertical axis. Here each of the first and second side support members 70, 72 define a plane and the planes lie not parallel to the vertical axis but obliquely relative to the vertical axis.

FIG. 5C shows the side support members 70, 72 in a locked position relative to the bassinet support members 94, 96. With the oblique orientation of the side support members 70, 72, the side support members 70, 72 are angled outwardly away from the ends 130, 132 of the bassinet receptacle 92 such that when the side support members 70, 72 are set on a surface such as a carpet or table top, tipping of the body 12 is minimized.

Figure 7A:
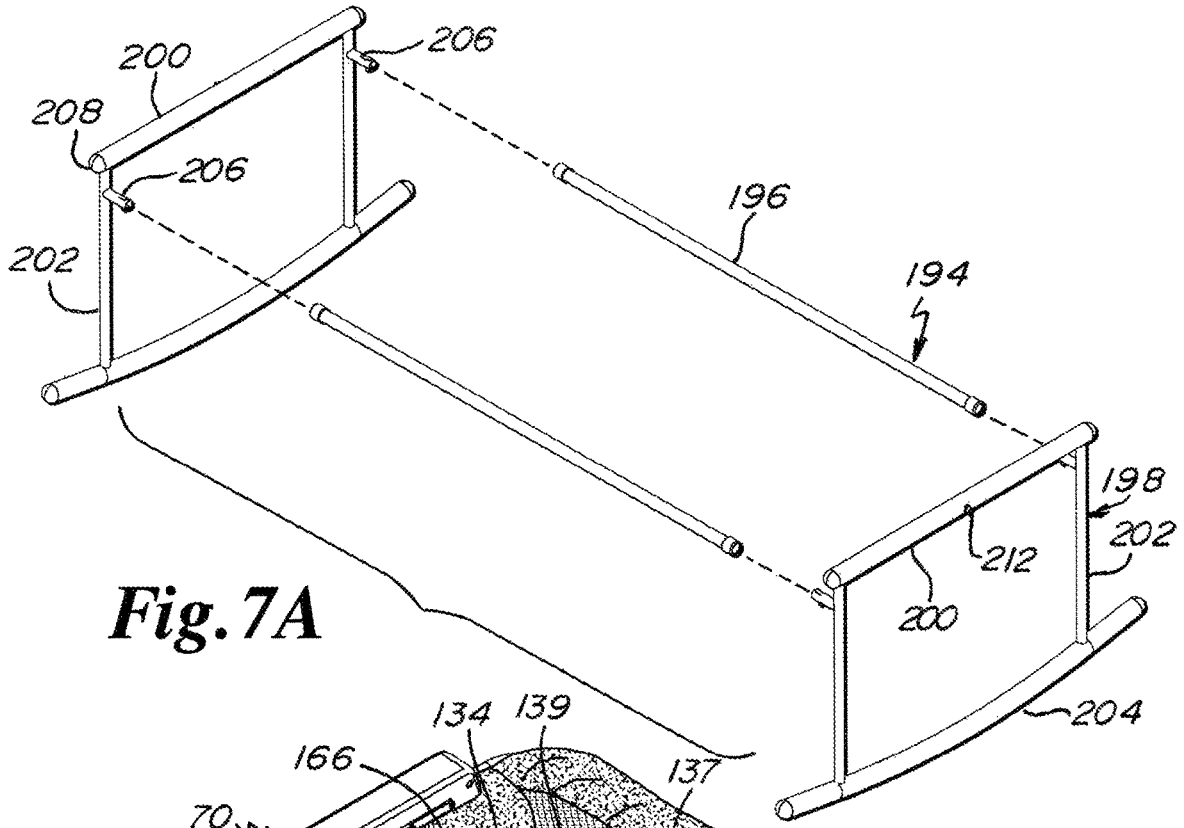
FIG. 7A is a perspective, broken apart view of the rocker base of FIG. 5C.
Figure 7B:
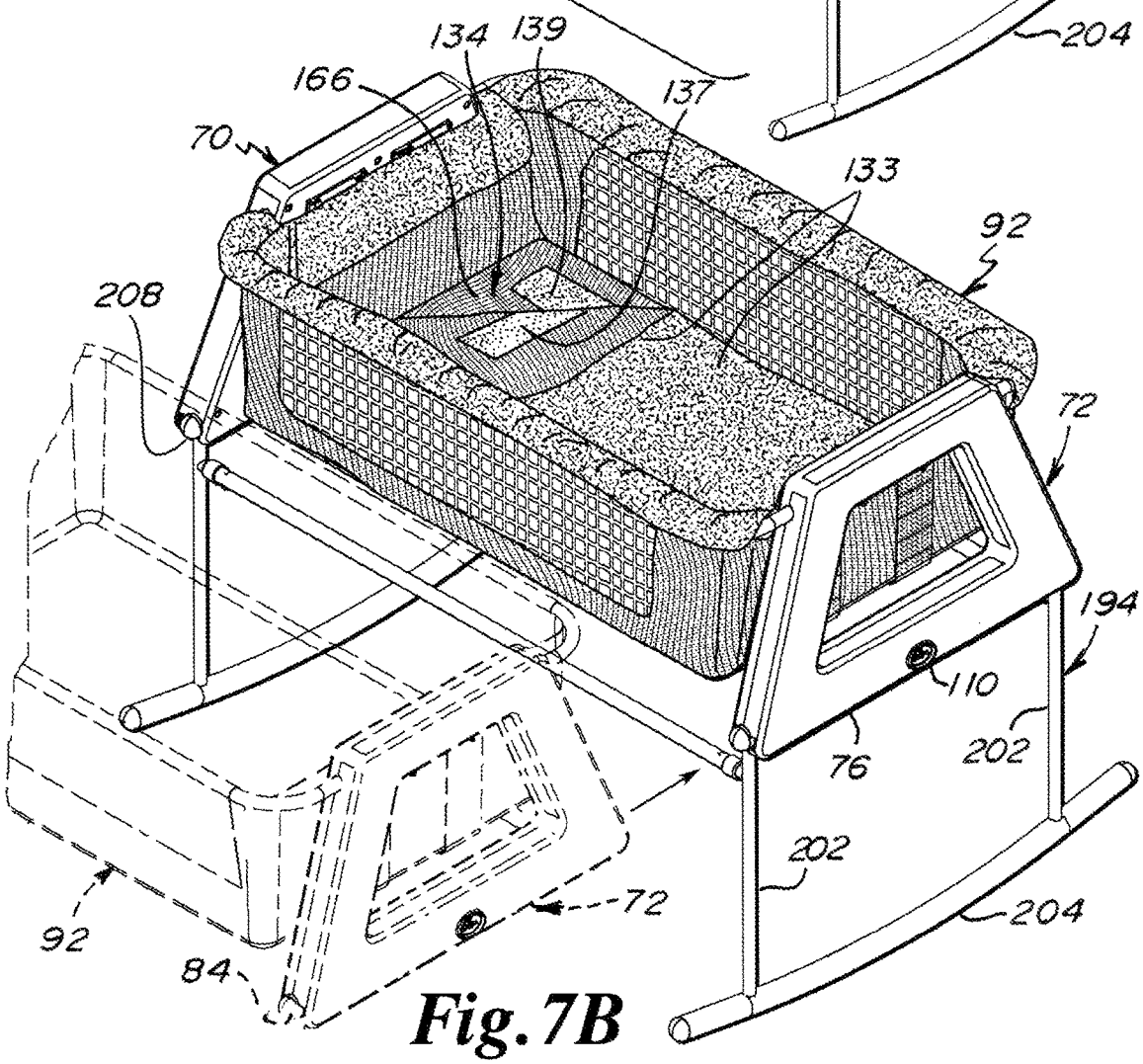
FIG. 7B is a partially phantom and perspective view of the body of the bassinet apparatus of FIG. 1 being engaged to the rocker base of FIG. 7A.

FIG. 5C, along with FIGS. 7A and 7B, show a rocker base 194 for the bassinet body 12. The rocker base 194 includes a pair of leg cross supports 196 spaced apart from each other, parallel to each other, and fixed relative to each other. The leg cross supports 196 are engaged to and between side rocker units 198. Each of the side rocker units 198 is one-piece and integral. Each of the side rocker units 198 includes an elongate support member 200, a pair of vertical legs 202, a rocker 204, and a pair of cross support receptors or receivers 206. Elongate support members 200 are spaced apart from each other, parallel to each other, and fixed relative to each other. Rocker 204, legs 202, and elongate support member 200 of each unit 198 define a unit plane and the unit planes run parallel to each other. The connection between the end of the elongate support member 196 and receiver 206 is a quick connect, where such quick connect connection includes a spring biased button housed in the receiver 206 and extending through a hole in the receiver 206. Such spring biased button then engages a hole in the end of the elongate support member 196 such that the elongate support member 196 can engage and disengage from the receiver 206 such that the rocker base 194 can be assembled and disassembled. Receiver 206 is received in the open end of the elongate support member 196. For the rocker base 194, there are four quick connects, one at each of the ends of each of the elongate support members 196. Each of the ends of the elongate support members 200 includes a spherical portion 208 that acts as a guide when the side support members 70, 72 slide onto the elongate support members 200. Spherical portion 208 is the first portion of the elongate support member 200 to encounter the end opening of the elongate receptor 84 that is formed in the bottom housing portion 76 of the side support members 70, 72. Receptor 84 includes an open bottom slot 85 that slidingly receives the legs 202 of the side rocker units 198 as the side support member 70 or 72 is slid onto the elongate support member 200, as shown in FIG. 7B.

FIG. 7B further shows that the side support members 70, 72 are slid fully onto the elongate support members 70, 72 until the spherical portions or proximal ends 208 of the elongate support members 200 have been slid beyond the ends of bottom housing portions 76. At rest, each of the ends of the elongate support members 70, 72 are disposed slightly beyond the ends of the bottom housing portions 76 and each of the ends have spherical end caps that work as visual indicators such that the user knows that the body 12 is properly engaged. The audio snapping out of button 212 and the visual and audio snapping out of button 110 also work as signals to the user that the body 12 is properly engaged.

FIG. 7A show that, to prevent scratching during assembly or use, a) rocker 204 has ends with spherical or rounded plastic caps, b) elongate support members 200 have ends with spherical or rounded plastic caps, and c) cross support members 196 have cylindrical end caps having openings to receive receivers 206, where such cylindrical end caps have an annular end portion with an inside diameter equal to the inside diameter of cross support 196 such that the terminal annular edge of cross support 196 is covered with such annular end portion of such cylindrical end cap, and where the reminder of such cylindrical end cap has an inside diameter equal to the outside diameter of the cross support 196. Such end caps do not cover up the button holes for the spring based button.

Figure 6B:
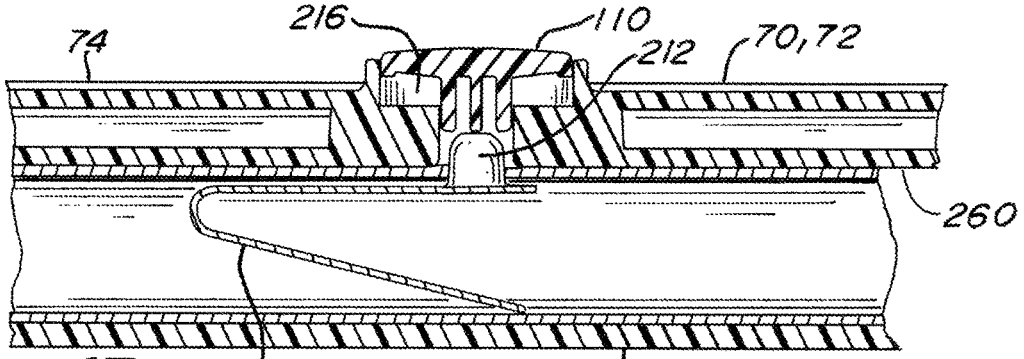
FIG. 6B is a section view of the locking arrangement of FIG. 6A between the base and first and second side support members of the body of the bassinet apparatus, and shows the locking arrangement locked such that the base and first and second side support members are fixed relative to each other.
Figure 6C:
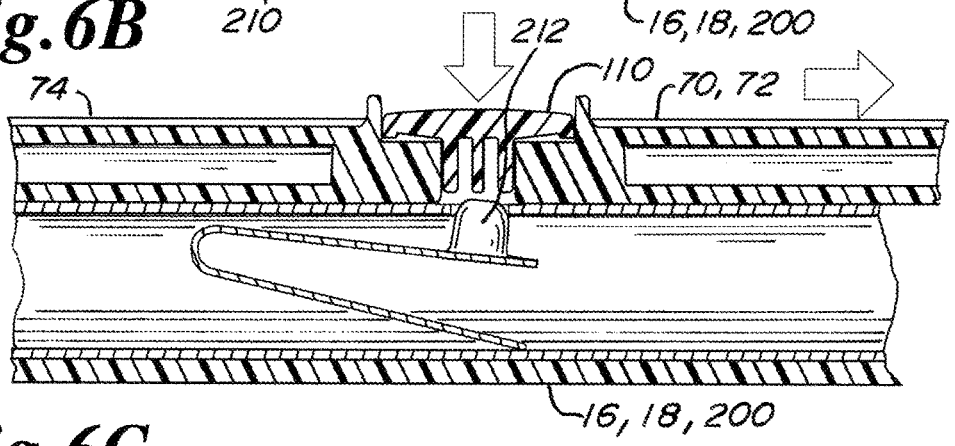
FIG. 6C is a section view of the locking arrangement of FIG. 6A between the base and first and second side support members of the body of bassinet apparatus, and shows the locking arrangement unlocked such that the side support members can slide relative to first and second elongate support members of the base.

FIGS. 6A, 6B, and 6C show how the side support members 70, 72 lock to the elongate support members 16, 18 of base 14 or to the elongate support members 200 of rocker base 194. Each of the elongate support members 16, 18, and 200 includes a V-shaped or U-shaped spring 210 having a first button 212. V-shaped spring 210 is compressed between opposing inner cylindrical surfaces of the elongate support member 16, 18, or 200. First button 212 extends through a button opening formed in the cylindrical wall of elongate support member 16, 18, 200. Even when the second button 110 is depressed fully inwardly, first button 212 remains at least partially in its button opening such that the V-shaped spring 210 does not slide axially or rotate radially in elongate support member 16, 18, or 200.

Each of the side support members 70, 72 includes the second button 110. Second button 110 is T-shaped and is engaged in a T-shaped opening 216. Second button 110 is slidingly engaged in T-shaped opening 216. When side support member 70 slides onto elongate support member 16 or 200 or when side support member 72 slides onto elongate support member 18 or 200, first button 212 is initially depressed by the proximal ends of a track 260 for button 212 of the elongate receptor 84 but, as such sliding continues, first button 212 encounters the T-shaped opening 216 and pops into such T-shaped opening 216, thereby locking the side support members 70, 72 to the respective elongate support member 16, 18, or 200. When first button 212 pops into the T-shaped opening 216, the first button 212 pushes the second button 110 outwardly, but second button 110 remains engaged to its respective side support member 70 or 72. To unlock the side support members 70, 72 from its respective elongate support member 16, 18, or 200, the second button 110 is depressed to depress first button 212 until the outside surface of first button 212 is within or adjacent to the outside surface of the elongate support member 16, 18, or 200, whereupon the side support member 70 or 72 can be slid off its respective elongate support member 16, 18, or 200.

Figure 9:
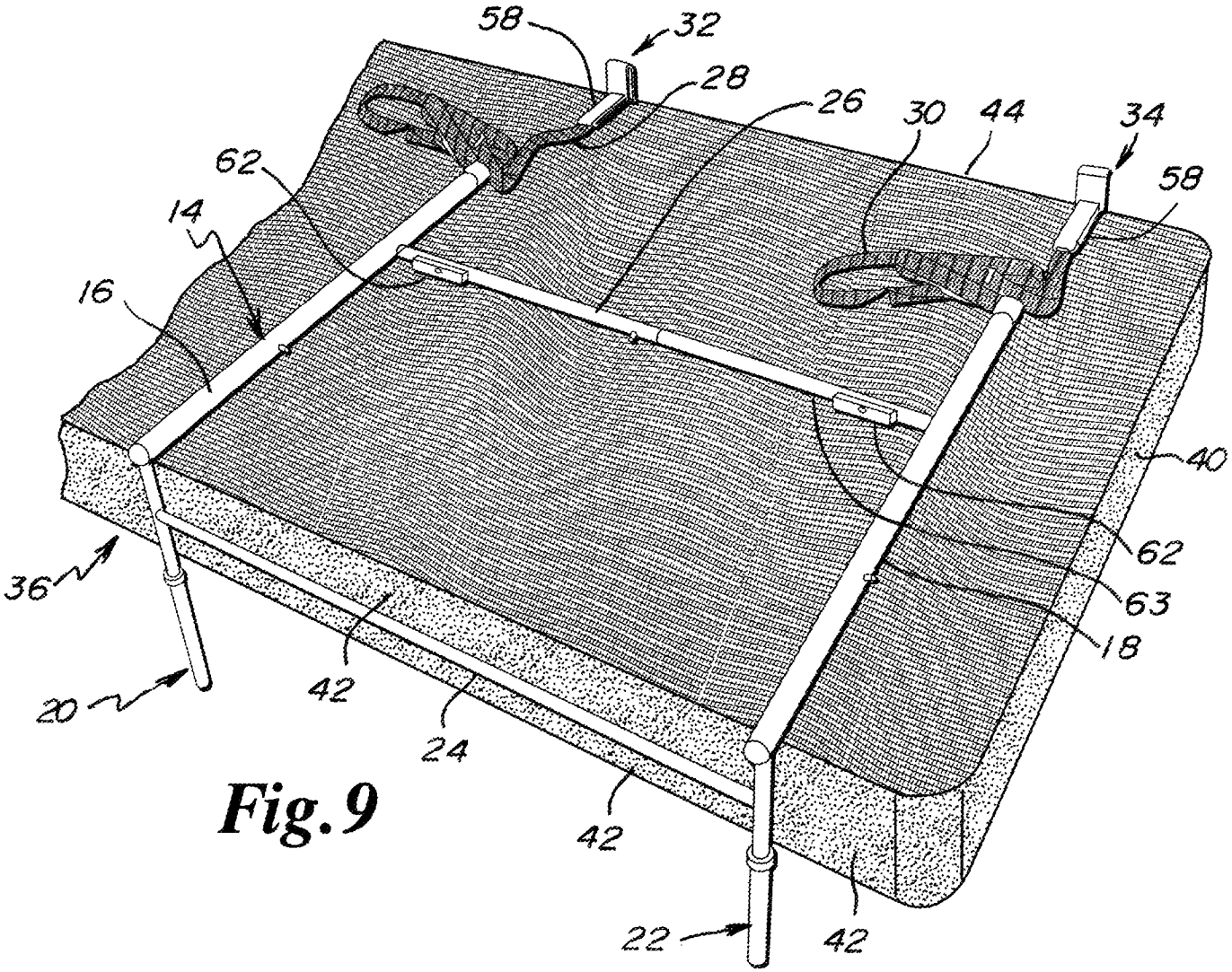
FIG. 9 is a perspective view of the base of the bassinet apparatus of FIG. 1, where portions of the base are slid into the bed between the mattress and the mattress support when the body of the bassinet apparatus is not being used, such as during the day, which is in contrast to FIG. 2 that shows use, for example, at night.

FIG. 9 shows the base 14 pushed to an out-of-the-way position when the body 12 is disengaged from the base 14. To push the base 14 from the position shown in FIGS. 1 and 2 to the out-of-the-way position shown in FIG. 9, the first steps are to disengage the body 12 from the base 14 by depressing the second buttons 110 to unlock the body 12 from the elongate support members 16, 18 and then sliding the body 12 off the elongate support members 16, 18. Then the proximal counter members 62 are turned horizontally such that the proximal counter members 62 no longer vertically confront sides 42, 64 of the mattress support 36 and mattress 56 and such that the proximal counter members 62 can slide between the mattress support 36 and mattress 56. Then the proximal counter members 62 slide therebetween when the legs 20, 22, elongate support members 16, 18, cross member 24, and cross member 26 are slid as a unit in the direction of the distal counter members 32, 34 and between the mattress support 36 and the mattress 56 until cross member 24 confronts and abuts the proximal side 42 of the mattress support 36 such that the base 14 is tucked away in an out-of-the-way position. In such a position, and with such sliding of such unit, the distal counter members 32, 34 remain engaged between the mattress support 36 and mattress 56 and remain confronting the distal sides 44, 55 of the respective mattress support 36 and mattress 56. Flexible straps 28, 30 lie slack until the base 14 is pulled back out of the bed until cross member 26 abuts and confronts the proximal side 42, 64 of the mattress support 36 and mattress 56, whereupon the proximal counter members 62 may be pivoted vertically such that the mattress support 36 and mattress 56 are again hugged or squeezed between the proximal counter members 62 and distal counter members 32, 34 to secure the base 14 such that the body 12 may be safely engaged to the base 14 at a location adjacent to the mattress support 36 and mattress 56.

Figure 10:
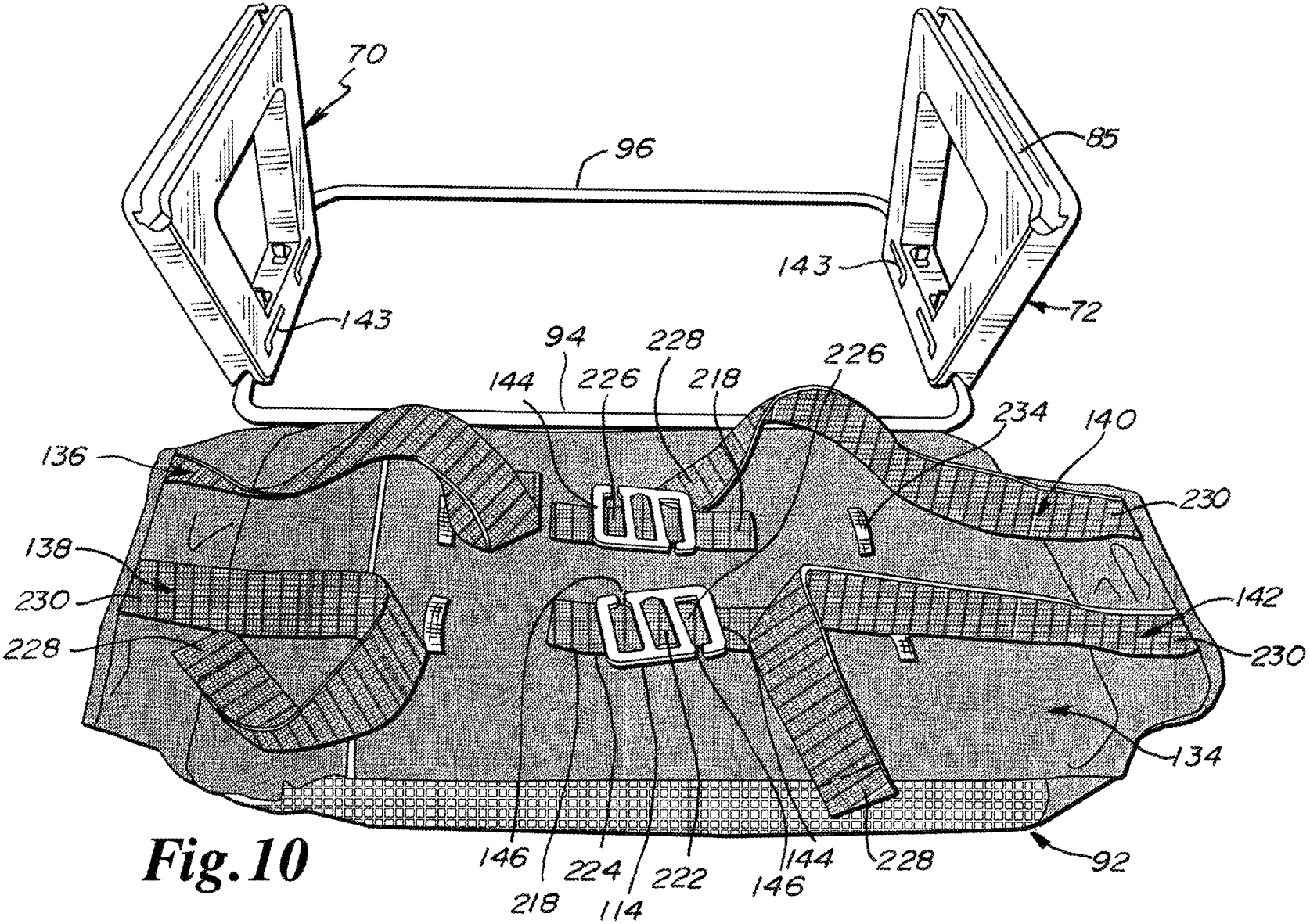
FIG. 10 is a perspective view of the bassinet receptacle of the bassinet apparatus disengaged from the frame of the bassinet apparatus of FIG. 1, where the underside of the bassinet receptacle is shown and where side support members of the frame are locked to the bassinet support members of the frame.

FIG. 10 shows the bassinet receptacle 92 isolated and disengaged from the body frame, i.e., the side support members 70, 72 and the bassinet support members 94, 96.

As to the bassinet receptacle 92, FIG. 10 shows that the buckles 114 are mounted on the bassinet receptacle 92 by respective flexible straps 218. Straps 218 are relatively short. The ends 224 of the straps 218 are stitched to the lower layer 168 while intermediate portions of the straps 218 remain free of the lower layer 168. Buckle 114 includes two slots 220 without side openings. Such slots 220 are vertically disposed. An intermediate portion 222 of strap 218 extends downwardly through one of the slots 220, over an integral elongate portion of buckle 114 disposed between the slots 220, and upwardly through the other slot 220 such that buckle 114 is engaged by the intermediate portion 222 of the strap 218 engaging the integral elongate portion of buckle 114 and by the strap ends 224 of the strap 218 being stitched to the lower layer 168. Strap 218, including its ends 224 and intermediate portion 222, does not engage opening 146 that leads into slot 226.

Each of the flexible straps 136, 138, 140, 142 includes a loop 228 formed at the distal end of the respective strap 136, 138, 140, 142. The loop 228 is formed by the respective strap 136, 138, 140, 142 itself. The terminal end of the strap 136, 138, 140, 142 is turned back and stitched to a portion of such strap that is spaced from the terminal end. Loop 228 is passed through opening 146 of buckle 114 and then engages clip 144 of buckle 114. Clip 144 is disposed at each of the ends of the buckle 114.

Each of the straps 136, 138, 140 includes a proximal end 230. Each of the proximal ends 230 is engaged, such as by stitching, to an upper top edge portion 232 of each of the flexible sides 130, 132 of the flexible receptacle 92. Starting from the proximal end 230 of each of the straps 136, 138, 140, 142, each such strap then engages the U-shaped bar 143 so as to pass between the bar 142 and the top housing portion 78, then each such strap extends downwardly on the outside of one of the ends 130, 132, then each such strap turns inwardly to extend across the lower surface of the lower layer 168, then each such strap passes through a restraining loop formed by flexible strip 234 and lower layer 168 to keep each such strap from bowing or hanging downwardly under the influence of gravity, then each such strap with its respective distal end loop portion 228 is slid through opening 146 and engages clip 144. There is only one portion of each of the straps 136, 138, 140, 142 that is stitched to the bassinet receptacle 92, and such only one portion is the proximal end 230 that is engaged to the top edge portion 232 of the ends 130, 132. Straps 136, 138, 140, 142 are preferably not adjustable.

By disengaging bassinet support members 94, 96 from receptors 158, 160 and by disengaging distal looped ends 229 from the buckles 114, then pulling the straps 136, 138, 140, 142 out of the loops formed by strips 234 and out of the loops formed by U-shaped portions 143, the bassinet receptacle 92 is removed from the side support members 70, 72 and bassinet support members 94, 96 for washing. The peg board or hard floor 162 is preferably removed prior to washing.

Straps 136, 138, 140, 142 provide end to end support for the bassinet receptacle 92 and provide support for the floor 134 of the bassinet receptacle 92. Straps 136, 138, 140, 142 engage the side support members 70, 72. Receptors 158, 160 provide side to side support for the bassinet receptacle 92. Receptors 158, 160 engage the bassinet support members 94, 96. It should be noted that side support members 70, 72 may be referred to as end support members because such members 70, 72 engage the straps 136, 138, 140, 142 that engage the ends 130, 132 of the bassinet receptacle 92. It should be noted that side support members 70, 72 may be referred to as bassinet support members because such members 70, 72 engage the straps 136, 138, 140, 142 that engage both the floor 134 of the bassinet receptacle 92 and the ends 130, 132 of the bassinet receptacle 92.

Figure 11A:
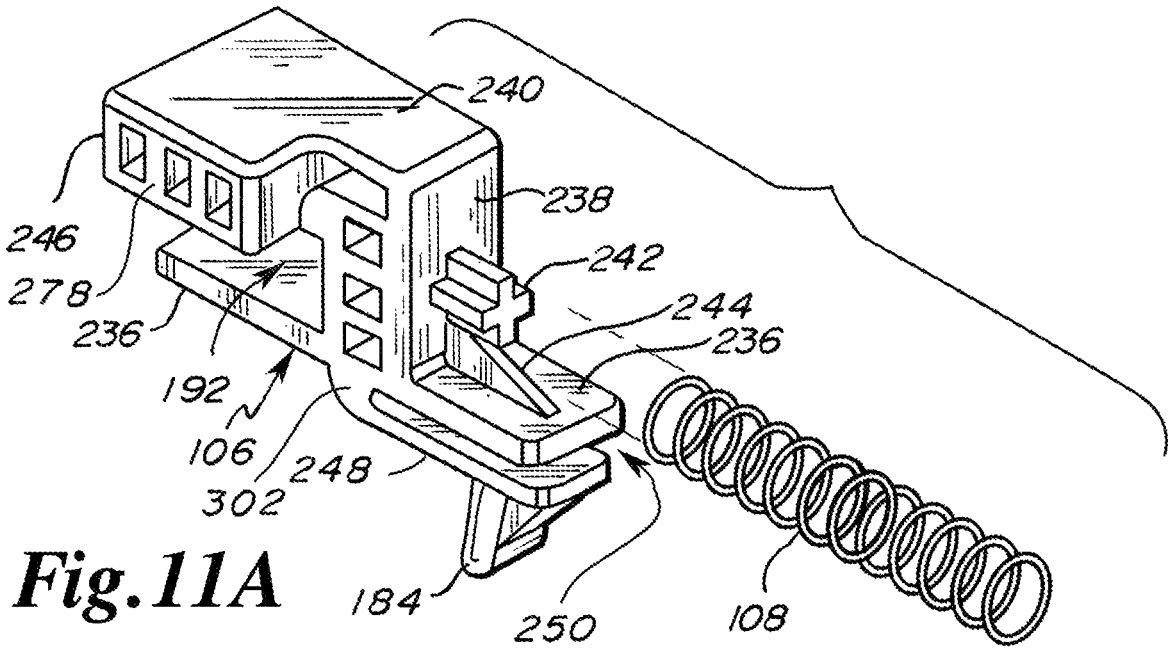
FIG. 11A is a perspective view of a trigger block and coil spring of the exploded view of FIG. 8.
Figure 11B:
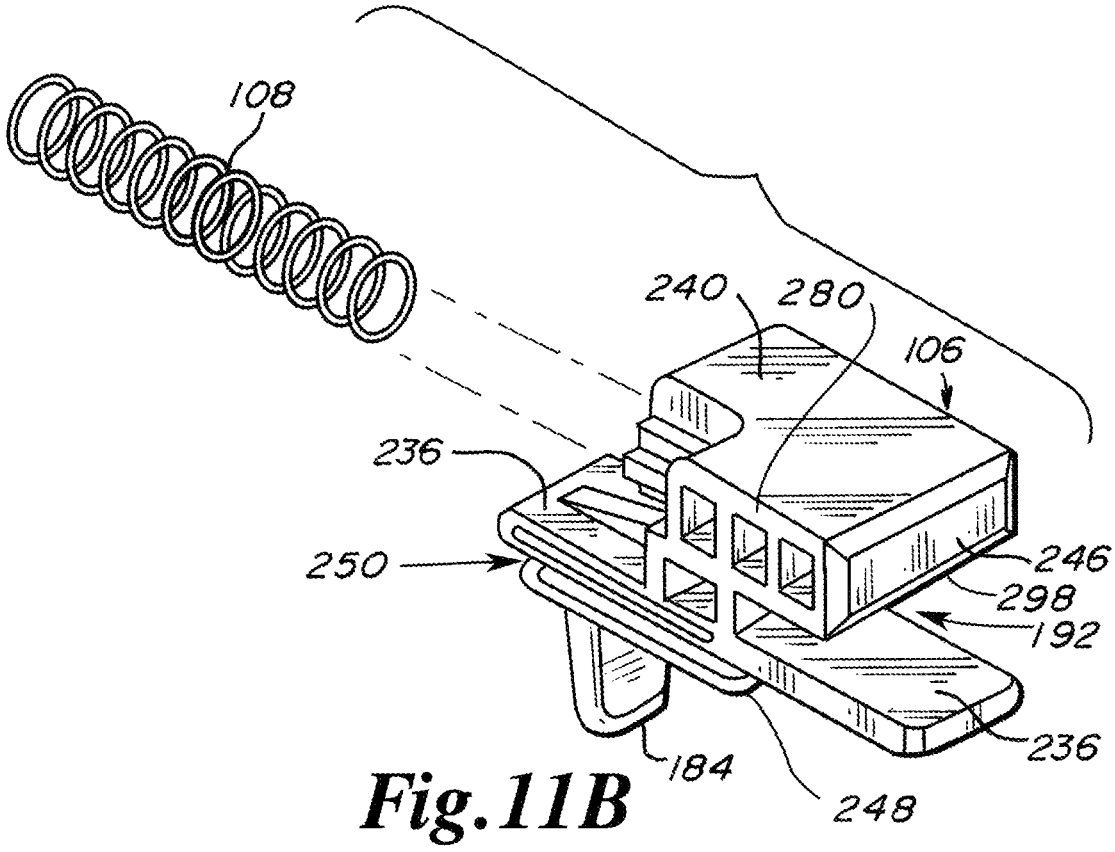
FIG. 11B is a second perspective view of the trigger block and coil spring of FIG. 11A and shows the other side of the trigger block of FIG. 11A.

FIGS. 11A and 11B show the trigger block 106. Trigger block 106 includes the trigger 184 that extends out of the top housing portion 78. This is the portion of the trigger block 106 that is engaged by the finger of the user and squeezed or pulled so as to disengage the side support members 70, 72 from the bassinet support members 94, 96. Interior portions of the trigger block 106 include an integral lower horizontal base 236, an integral vertical support 238, and an integral upper horizontal base 240. Trigger 184 depends from one portion of the lower horizontal base 236. Integral upper horizontal base 240 extends over another portion of the lower horizontal base 236 and area 192 is formed between such portion of the lower horizontal base 236 and the integral upper horizontal base 240. Vertical support 238 includes a ribbed receptor 242 for coil spring 108 and a triangular plate portion or brace 244 that reinforces the integral connection between the vertical support 238 and the lower horizontal base 236. The brace 244 also may act to pinch the end of the coil spring 108 between the brace 244 and the receptor 242 to pinch the coil spring 108 to the trigger block 106. Upper horizontal base 240 includes a face 246 that abuts the end 123 of the U-shaped portion 122 when the U-shaped portion 122 is received in area 190. Trigger block 106 is essentially part of its respective side support member 70, 72 and pivots when the side support members 70, 72 pivot. Such pivoting brings area 190 into a position that surrounds U-shaped portion 122 and brings face 123 to abut in a cross ways fashion face 246 of the trigger block 106. One end of base 236 opposes an upper base portion 248 of the trigger 184. Upper trigger base portion 248 and such end of base 236 form a slot or receptor 250 for receiving plate portions 252, shown in FIG. 5A, of the upper housing portion 78 to minimize vertical movement of the trigger 184 when the trigger 184 is sliding by a pulling (when the coil springs 108 are compressed) or sliding by a release (when the coil springs 108 expand).

When the side support members 70, 72 and bassinet support members 94, 96 are unlocked and the triggers 184 are squeezed together and the side support members 70, 72 are pivoted fully away from a plane defined by bassinet support members 94, 96, face 246 lies above end 123 and space 190B is empty. Here space 190A is occupied by U-shaped member 122.

When the side support members 70, 72 and bassinet support members 94, 96 are unlocked and the triggers 184 are squeezed together and the side support members 70, 72 are pivoted to be substantially in a plane defined by bassinet support members 94, 96, face 246 abuts end 123 in a crosswise fashion and each of spaces 190A and 190B is occupied by the U-shaped member 122.

When the side support members 70, 72 are pivoted and are brought to a locked position, face 246 and end 123 pivot relatively against each other until the elongate face 246 and elongate end are parallel, whereupon the coil springs 108 pushingly snap the upper horizontal base 240 into the upper portion 190B of area 190 and the U-shaped portion 122 is snappingly received into receptor 192. Here the triggers 184 are disposed at their furthest distance apart from each other.

Then, when the triggers 184 are squeezed, upper horizontal base 246 slides out of the upper portion 190B of area 190 and receptor 192 slides out of engagement with U-shaped portion 122. When trigger block end face 246 is coplanar with end 123, face 246 and ends 123 can pivot relative to each other and U-shaped portion 122 can be received in the upper portion 190B of area 190 such that the side support members 70, 72 may be pivoted inwardly relative to the bassinet support members 94, 96. Here U-shaped portion 122 is also in the lower portion 190A of area 190.

Interior surface portions of top housing portions 78 keep trigger blocks 106 housed therein and sliding along a straight axis with minimal side to side movement and with minimal vertical movement. Interior surface portions of top housing portions 78 keep the bassinet support member ends 116 in the top housing portions with minimal side to side movement, minimal vertical movement, and minimal axial movement, but permit the bassinet support member ends 116 and U-shaped portions 122 to pivot relative to the top housing portions 78.

Figure 12A:
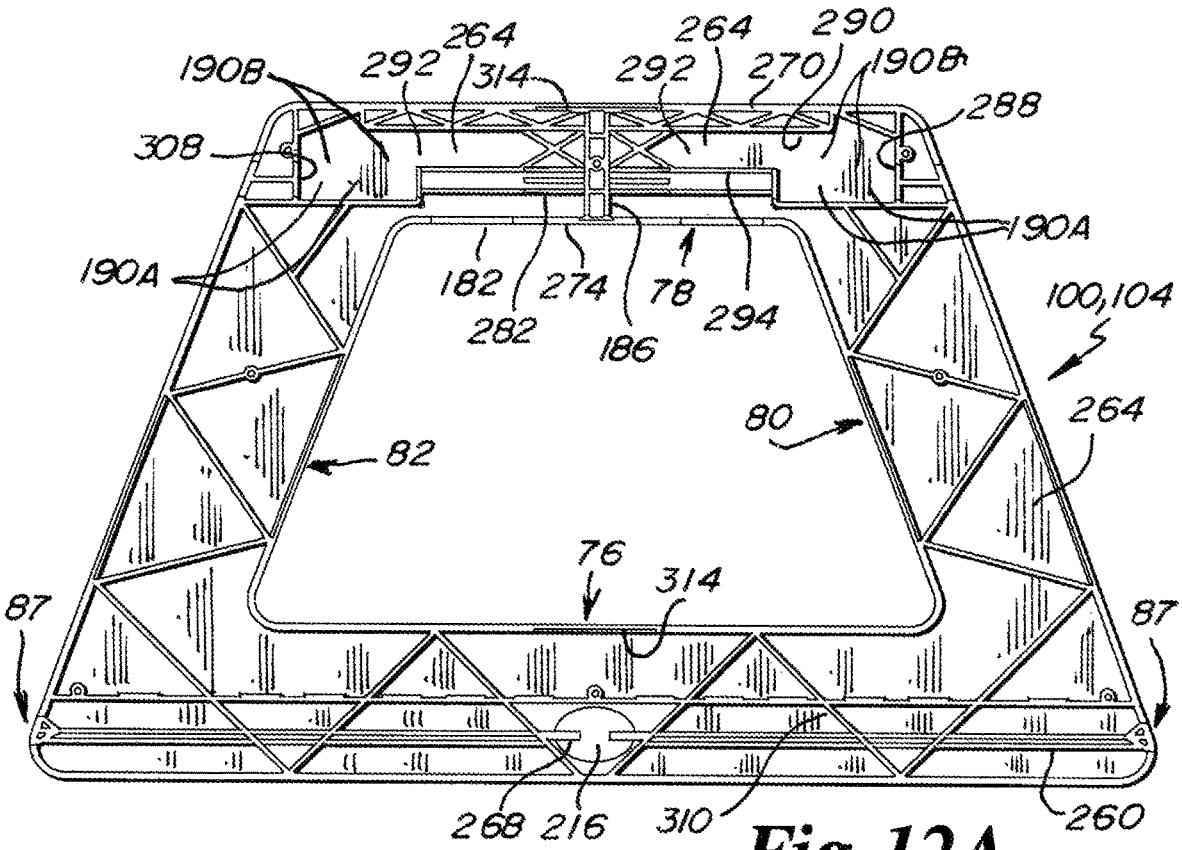
FIG. 12A shows an elevation side interior view of the outer half portion of the housing of a side support member of the body of the bassinet apparatus of FIG. 1.
Figure 12B:
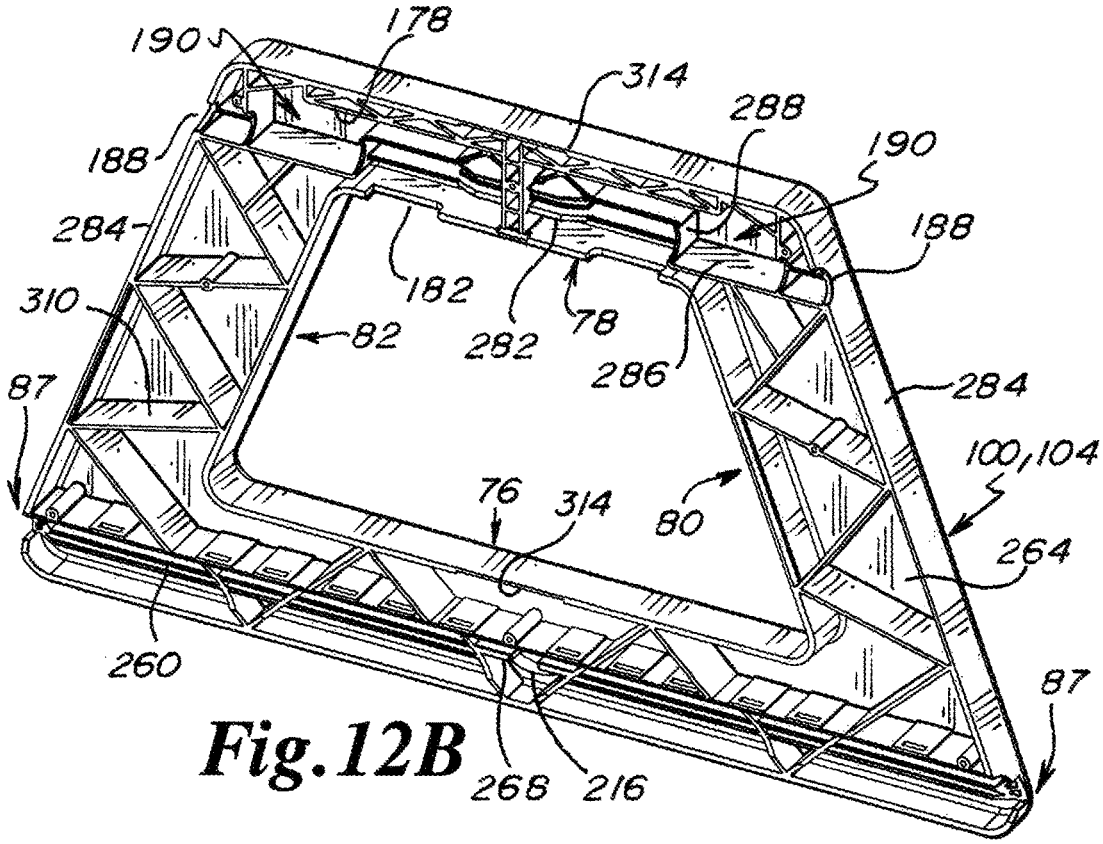
FIG. 12B shows a perspective side interior view of the outer half portion of the housing of the side support member of FIG. 12A.
Figure 13A:
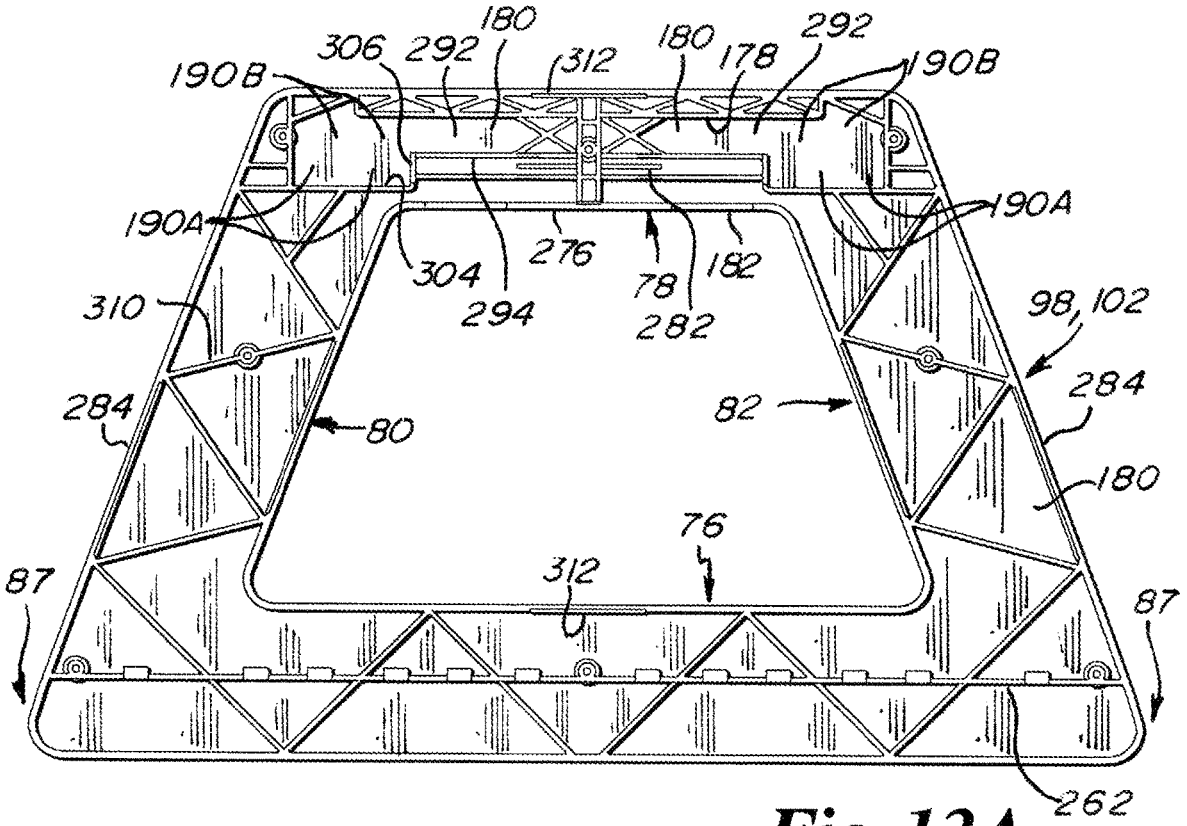
FIG. 13A shows an elevation side interior view of the inner half portion of the housing of the side support member of FIG. 12A.
Figure 13B:
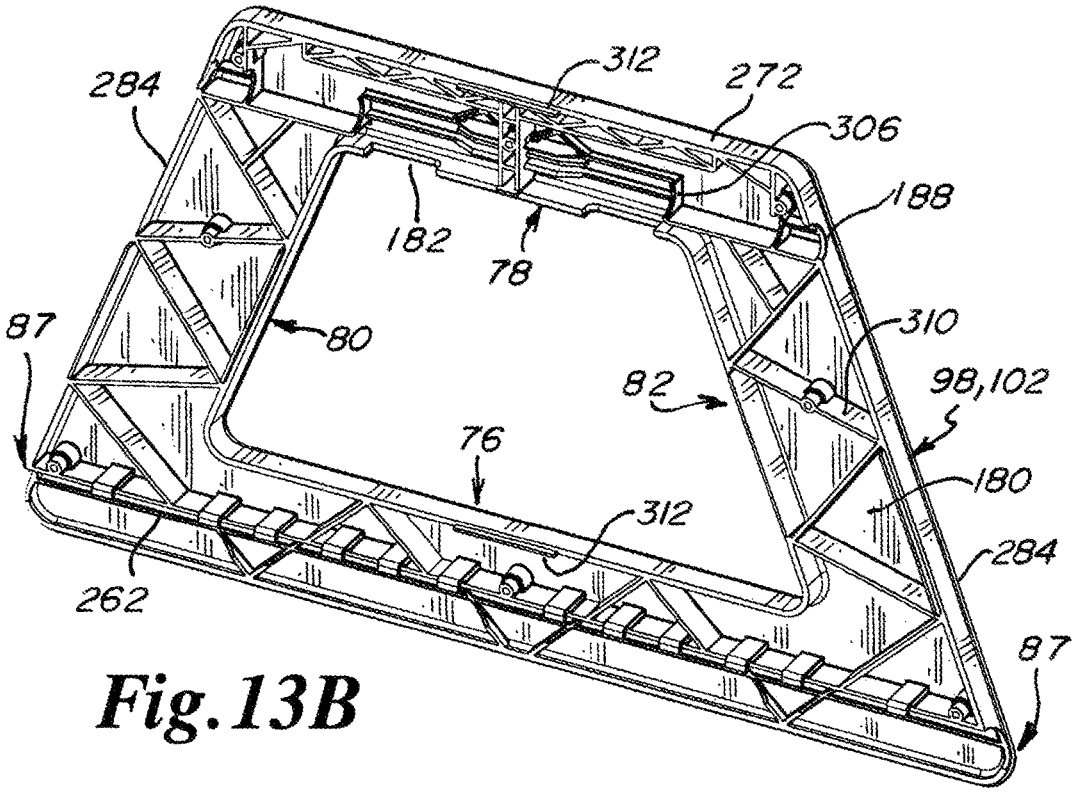
FIG. 13B shows a perspective side interior view of the inner half portion of the housing of FIG. 13A.

FIGS. 12A, 12B show views of the outer half portion 100, 104 of the housing 256 of side support member 70 or 72 of the body 12 of the bassinet apparatus 10. FIGS. 13A, 13B show views of the inner half portion 98, 102 of the housing 256 of side support member 70 or 72 of the body 12 of the bassinet apparatus 10. Outer half portions 100, 104 and their respective inner half portions 98, 102 without the trigger block 106 make up housing 256.

Outer half portion 100, 104 of housing 256 includes a button track 260 that extends from just inside one opening 87 to just inside the other opening 87. Button 212 is depressed by this track 260 so as to compress spring 210. Button 212 extends from one side of elongate support member 16, 18, 200. The other side of elongate support member 16, 18, 200 slidingly confronts and engages an elongate wall 262 extending from just inside one opening 87 to just inside the other opening 87. Track 260 is formed by two walls spaced apart and extending from an outer face wall 264 of outer housing portion 100, 104. Elongate wall 262 extends from face wall 180 of inner housing portion 98, 102. The two spaced apart but adjacent walls that make up track 260 merge into a single wall track portion 268 that continues to depress button 212 but that then terminates at T-shaped opening 216, whereupon button 212 audibly pops out and pushes button 110 outwardly. When button 110 is pushed inwardly, button 110 engages button 212 and pushes button 212 inwardly such that, when side support members 70, 72 begin to slide off of elongate support members 16, 18, 200, the outer face of button 212 rides in a depressed state on track 260 to end opening 87, whereupon button 212 pops out.

Each of housing half portions 98, 100, 102, 104 includes an elongate inner housing portion 178 that slidingly engages trigger blocks 106 and U-shaped portions 122 from above. Elongate inner housing portion 178 depends from an outer perimeter top wall 270 of outer half portions 100, 104 and an outer perimeter top wall 272 of inner half portions 98, 102. Upper faces of an inner perimeter top wall 274 of outer half portions 100, 104 and upper faces of an inner perimeter top wall 276 of inner half portions 98, 102 slidingly engage from below bottom faces of lower horizontal base 236 of trigger blocks 106. Each of the half portions 98, 100 includes inner face wall 180 that relatively slidingly engages trigger blocks 106 on one side 278, 280 of the trigger block 106. Each of the half portions 100, 104 includes outer face wall 264 that relatively slidingly engages trigger blocks 106 on the other side 278, 280 of the trigger block 106. Inner perimeter top walls 274, 276 includes openings 182 that receive triggers 184 of the trigger blocks 106. Plate portion 252 is a portion of inner perimeter top walls 274, 276.

Internal vertical wall 186 depends from elongate inner housing portions 178. One end of coil spring 108 abuts this internal vertical wall 186 and the other end of the coil spring 108 engages receptor 242 on trigger block 106. Sides of the coil spring 108 are engaged by a set of three ribs 282 extending horizontally from the internal vertical wall 186 and further extending horizontally from outer face wall 264 and inner face wall 180 such that the coil spring 108 is engaged from the sides as coil spring 108 approaches and makes contact with internal vertical wall 186.

Circular openings 188 are form in outer perimeter oblique side walls 284 for engaging end portions 116 of the bassinet support members 94, 96. General open area 190 receives the U-shaped portion 122 of the bassinet support members 94, 96 and further receives portions of the trigger block 106.

General open area 190 communicates with circular openings 188. General open area 190 includes area portion 190A and area portion 190A.

General open area 190 is formed at least in part by floor portions 286, sidewall portions or ribs 288, and ceiling portions 290 that are integral with housing 256 and extend from outer face wall 264 and inner face wall 180. General open area 190 is in communication with area 292 where upper horizontal base 240 of trigger block 106 slides. Area 292 is formed in part by ceiling 290 that is the lower surface of housing portion 178 and an upper rib or floor 294 that is an extension of the upper rib of ribs 282. The lower and upper ribs of ribs 282 extend to upright rib 306. Upper horizontal base 240 of trigger block 106 also slides into area portion 190B to lock the U-shaped portion 122.

Sidewall portion or rib 288 includes a receptor or curved or rounded mount for receiving and engaging bassinet support member end 116 such that bassinet support member end 116 is engaged 1) by the receptor in rib 288, 2) by opening 188, and 3) by the circular or rounded mount formed in the side of rib 306.

When the trigger blocks 106 lock the U-shaped portions 122 in place such that the side support members 70, 72 cannot rotate relative to the bassinet support members 94, 96, the U-shaped portions 122 reside in area portion 190A, shown in FIGS. 12A and 13A, with upper horizontal base 240 of trigger block 106 residing in at least a portion of area portion 190B.

Trigger block 106 slides back and forth with no pivoting. Relative to the side support member 70, 72 in which U-shaped portion 122 is housed, U-shaped portion 122 pivots back and forth with no sliding.

Face 123 of U-shaped portion 122 includes opposing straight edges. When body 12 is in the operative and upright position and U-shaped portion 122 is locked by trigger block 106, these straight edges run horizontally. One straight edge is upper edge 296. Upper edge 296 is formed by the junction of face 123 and face 300 of the U-shaped portion 122. Face 300 is shown in FIG. 5B. When body 12 is in the compact position and is on a horizontal surface such as shown in FIG. 3A, these straight edges also run horizontally. In other words, side support members 70, 72 are pivoting, not U-shaped portions 122.

Trigger block 106 includes a face 246. Face 246 is surrounded by four oblique edges. One of these oblique edges is a lower edge 298 in the orientation shown in FIGS. 11A and 11B.

When body 12 is in the compact position, U-shaped portion 122 resides in both area portions 190A, 190B. When side support members 70, 72 are being pivoted from the stored to operating positions, face 246 of trigger block 106 snaps into area portion 190B when oblique straight edge 298 becomes parallel to straight upper edge 296 of U-shaped portion 122. Prior to such snapping, face 246 of trigger block 106 is abutting against and pivoting against face 123 of U-shaped portion 122.

When body 12 is in the compact position, U-shaped portion 122 is in each of area portions 190A, 190B. When body 12 is in the operative position, U-shaped portion is in only portion 190A.

Figure 14A:
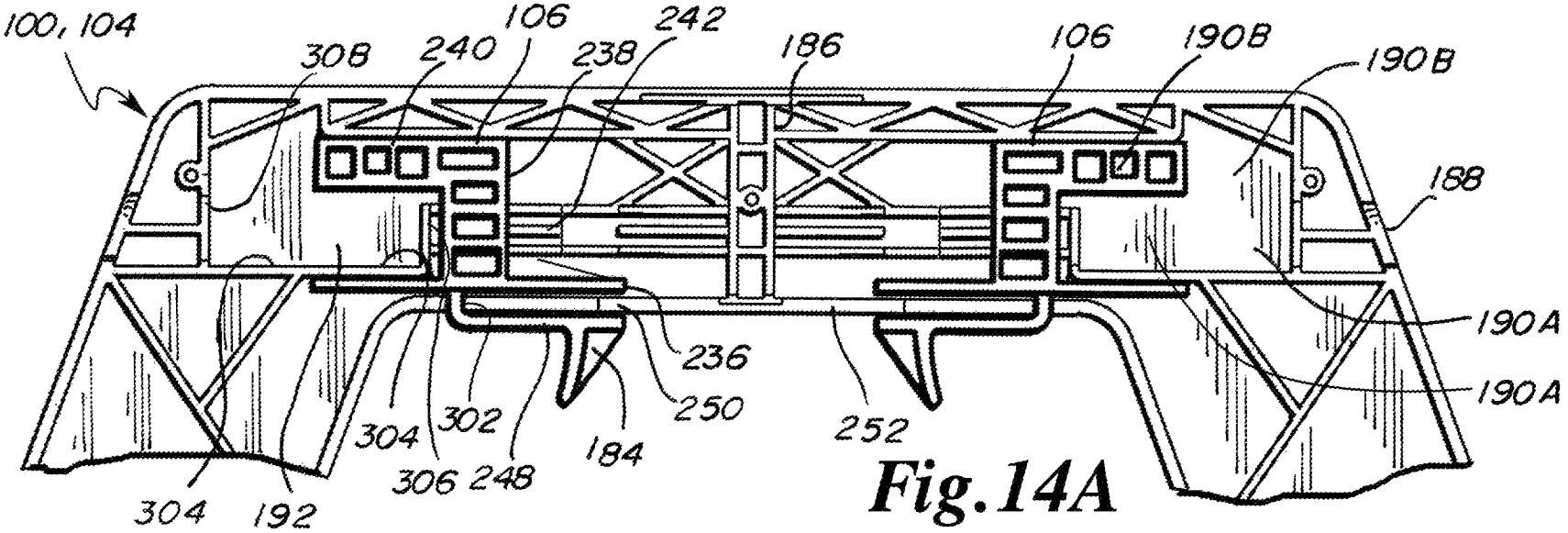
FIG. 14A shows a detail side elevation view of the trigger and lock mechanism of FIG. 5A with the triggers drawn apart and without the coil springs for clarity.
Figure 14B:
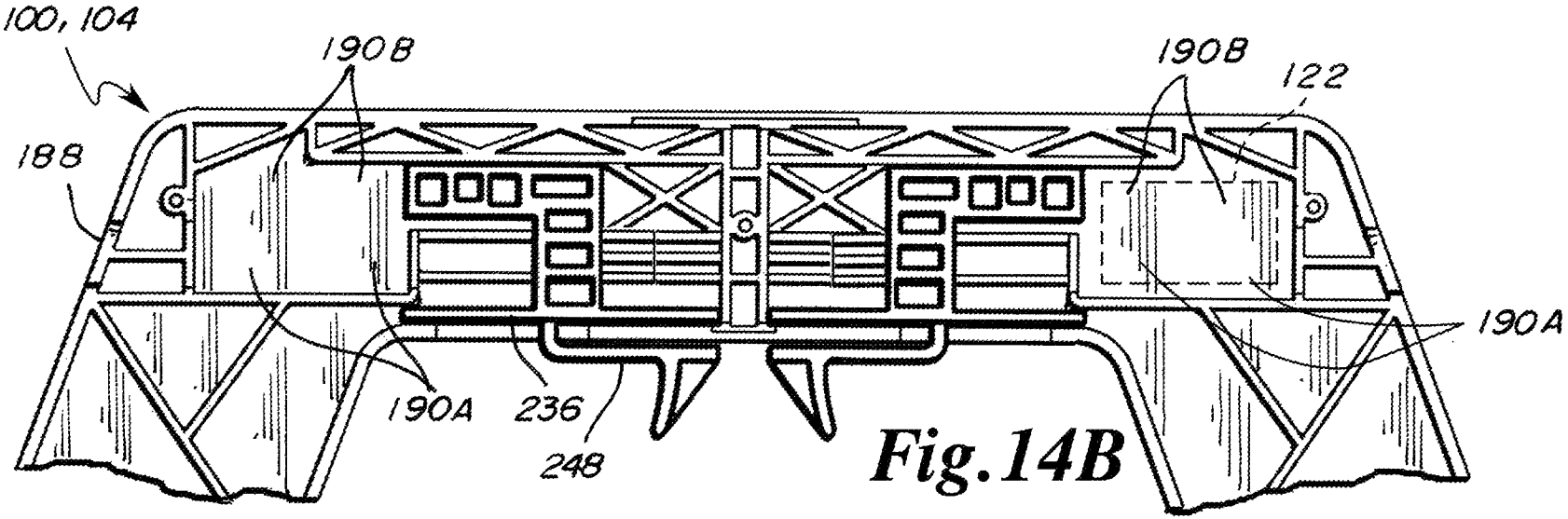
FIG. 14B shows the detail side elevation view of the trigger and lock mechanism of FIG. 5B with the triggers drawn together and without the coil springs for clarity.

FIG. 14A shows the trigger blocks 106 in half portion 100, 104 without coil springs 108 and with triggers 184 drawn apart to lock the trigger blocks 106 over the U-shaped portion 122 to lock the side support members 70, 72 against rotation relative to the bassinet support members 94, 96. FIG. 14B shows the trigger blocks 106 in half portion 100, 104 without coil springs 108 and with the triggers 184 drawn together to permit the side support members 70, 72 to rotate relative to the bassinet support members 94, 96.

To relate the trigger blocks 106 of FIG. 14A to FIG. 12A that does not show the trigger blocks 106, the trigger block 106 will be described from the bottom up. Trigger 184 is disposed at the bottom of the trigger block 106 when the base 14 is in the operative position on elongate members 16, 18. Trigger 184 is generally triangular shaped when viewed from the side and depends from plate portion 248. Plate portion 248 opposes a section of plate portion 236 and, in doing so, forms slot 250. Slot 250 receives a plate portion 252 of the inner perimeter top wall 274. Plate portion 248 is engaged to plate portion 236 by an upward block extension 302. Upward block extension 302 slides back and forth in opening 182. The sides of upward block extension 302 work as stops for the back and forth sliding of the trigger block 106 when such sides hit the ends of the openings 182. While one section of plate portion 236 opposes plate section 248, the other section of plate portion 236 opposes upper horizontal base or lock portion or block portion 240 and, in so doing, forms receptor 192 for receiving U-shaped portion 122. Such other section of plate portion 236 slides on a bottom face of housing rib 304. Housing rib 304 is disposed in receptor 192. Rib 304 runs inwardly and then turns upwardly to form rib 306. Rib 306 runs adjacent to vertical support 238 of trigger block 106 such that vertical support 238 of trigger block 106 does not slide into area 190 or area portion 190A or area portion 190B. Vertical support 238 of trigger block 106 slides on a section of ribs 294. Block portion 240 is a portion of the trigger block 106 and extends into area 190B to slide over the U-shaped portion 122 when the triggers 184 are released. Block portion 240 slides out of area 190B when the triggers 184 are drawn in, as shown in FIG. 14B. Opposite of receptor 192, on the other side of the vertical support 238, the coil spring receptor or mount 242 extends from the vertical support 238. The upper face of block portion 240 slides up against housing portion 178. U-shaped portion 122 effectively does not pivot. Instead, housing portion 100, 104 pivots about the U-shaped portion 122. Housing portion 100, 104 pivots when the triggers 184 are drawn in and block portion 240 is removed from area 190B. Then area 190B receives U-shaped portion 122 as the housing portion 100, 104 pivots relative to the bassinet support members 94, 96. The side edge of rib 306 is curved to serve as a mount for the terminal end 124 of bassinet support member 94, 96. Each of the ribs 306 has a mate or counterpart on the other housing portion 98, 102 so as to capture the cylindrical terminal end 124. U-shaped housing portion 122 confronts rib 304, rib 306, outer wall 264 of housing half portions 100, 104 (and outer wall 180 of half portions 98, 102), housing portion 178, and rib 308 that has a receptor for bassinet support member end 116.

As shown in FIGS. 12A, 12B, 13A, and 13B, oblique braces 310 or oblique ribs 310 extend to and between the inner and outer perimeter walls of bottom housing portion 76, side housing portion 80, and side housing portion 82. The oblique braces or ribs 310 in bottom housing portion 76 are oblique relative to the straight housing floor portion of bottom housing portion 76 that ribs 310 engage and that defines a plane. The oblique braces or ribs 310 in side housing portion 80 are oblique relative to the straight outer perimeter side 284 that the ribs 310 engage and that defines a plane. The oblique braces or ribs 310 in side housing portion 82 are oblique relative to the straight outer perimeter side 284 that the ribs 310 engage and that defines a plane. The ribs 310 form a Z-pattern. The ribs 310 extend alternately from an outer perimeter wall portion to an inner perimeter wall portion and so on, except at the junctions of bottom housing portion 76 and side housing portions 80, 82 where one oblique rib 310 extends from an outer perimeter wall portion of bottom housing portion 76 to an outer perimeter wall portion of either side housing portion 80 or side housing portion 82.

Housing portion 102 is engaged to housing portion 104 with pin connectors 112. Prior to such an engagement, upper and lower tongues 312 of housing portion 102 may be located in upper and lower tongue receptor slots 314 of housing portion 104. Tongues 312 extend from and tongue receptor slots 314 are formed in the inner trapezoidal perimeter wall of the respective housing portions 102, 104.

Housing portion 98 is engaged to housing portion 100 with pin connectors 112. Prior to such an engagement, upper and lower tongues 312 of housing portion 98 may be located in upper and lower tongue receptor slots 314 of housing portion 100. Tongues 312 extend from and tongue receptor slots 314 are formed in the inner trapezoidal perimeter wall of the respective housing portions 98, 100.

The U-shaped portion 122 is shown in phantom in FIG. 14B. In the compact and stored position of body 12 as shown in FIG. 3A, the trigger block 106 abuts against the U-shaped portion 122. And then, when the side support members 70, 72 are swung out so as to pivot relative to the bassinet support members 94, 96, the trigger block 122 keeps abutting the U-shaped member 122 until the trigger block 122 snaps over the U-shaped portion 122, thereby providing an audible signal to the user of a locked condition as shown in FIG. 3B. It is therefore preferred that the triggers 184 are not operated during the swinging out of the side support members 70, 72 from the compact and stored position so as not to provide the space shown in FIG. 14B. However, it is preferred that the triggers 184 are operated when the opposite is undertaken. In other words, when the triggers 184 are fully drawn together, the trigger block 106 is spaced from the U-shaped member 122 as shown in FIG. 14B, and this permits free movement of the trigger block 106 relative to the U-shaped member 122 such that the side support members 70, 72 pivot freely relative to the bassinet support members 94, 96 and can pivot freely to their stored and compact position shown in FIG. 3A with no friction between the trigger block 106 and the U-shaped member 122.

In operation, with reference to FIG. 1, the base 14 may be assembled. Lower leg portions 66 may be engaged to their respective upper leg portions 68. Upper leg portions 68 are part of a T-shape unit. Each upper leg portion 68 is welded to one half portion of cross support 24. The T-shape units are engaged by a quick connection at the inner ends of the half portions of cross support 24. This part of the assembly process results in an H-shaped base portion.

Then half portions 63 are engaged by quick connection 65 shown in FIG. 6A such that elongate support members 16, 18 are engaged to each other. This part of the assembly also results in an H-shaped base portion.

Then the proximal ends 46 of the elongate support members 16, 18 are engaged to upper leg portions 68 such that buttons 69 engage button openings in the upper leg portions 68. This part of the assembly process results in the legs 20, 22 and cross support 24 defining a plane that is disposed at a right angle relative to a plane defined by the elongate support members 16, 18 and cross support member 26.

Then upper leg portions 68 may be adjusted relative to lower leg portions 66 to dispose the elongate support members 16, 18 at the height of the upper surface 38 of the mattress support 36. Then the distal end portions 48 of the elongate support members 16, 18 are disposed on the upper surface 38 of the mattress support 36 such that cross support member 26 is disposed at the proximal side 42 of the mattress support 36 and such that proximal counter members 62, after being pivoted to be disposed vertically, confront the proximal side 42 of the mattress support 36. Then the lengths of the first and second straps 28, 30 are adjusted such that distal counter members 32, 34 engage the distal side 44 of the mattress support 36.

Then, referring to FIG. 2, the mattress 56 may be placed on the mattress support 36. Then the first and second straps 28, 30 are tightened such that the mattress support 36 and mattress 56 are hugged or squeezed between the proximal counter members 62 and the distal counter members 32, 34 so as to provide a stable base 14 for the bassinet body 12.

Then, referring to FIGS. 3A and 3B, the bassinet body 12 is unpacked from the form in which it is shipped, whether such form is flat and planar or whether such form is substantially flat as shown in FIG. 3A, to the fully unpacked and locked form shown in FIG. 3B. This is done by pivoting the side support members 70, 72 outwardly until, referring to FIG. 5B, the trigger blocks 106 are oriented to receive the U-shaped portions 122 of the ends 116 of the bassinet support members 94, 96 in the receivers or receptors 192 of the trigger blocks 106. Prior to such pivoting the U-shaped portion 122 resides in the upper portion 190B and lower portion 190A of open area 190 of the upper housing portions 78 of the side support members 70, 72 where face 246 of the trigger block 106 abuts the face 123 of the U-shaped portion 122 in a cross-wise fashion. When the trigger blocks 106 are so oriented to receive U-shaped portions 122, the trigger blocks 106 automatically under pressure from the coil springs 108 snap onto the U-shaped ends 122, thereby locking the side support members 70, 72 to the bassinet support members 94, 96. This locking results in the oblique orientation shown in FIG. 5C, where the base is base 14 or rocker base 194.

After the side support members 70, 72 have been locked relative to the bassinet support members 94, 96, the straps 136, 138, 140, 142 may be engaged to the buckles 114 if such straps have not already been engaged. It should be noted that the straps 136, 138, 140, 142 are preferably engaged to the buckles 114 at the factory and shipped in such state. It should be noted that the bassinet receptacle 92 is preferably engaged to the bassinet support members 94, 96 by the receptors 158, 160 on each of the sides of the bassinet receptacle 92 at the factory and is shipped in such state.

Then the locked bassinet body 12 may be slid onto the bed base 14 by sliding the side support members 70, 72 onto the elongate support members 16, 18 until the first buttons 212 of the elongate support members 16, 18 snap into the T-shaped openings 216 of the side support members 70, 72. The user feels this snapping taking place and also sees the proximal ends 46 extend beyond the open ends of openings 84 so as to close the open ends of the openings 84 of the side support members 70, 72. At this locked position, the bassinet receptacle 92 is adjacent to the mattress 56.

Referring to FIG. 7A, the rocker base 194 is assembled by employing the quick connection in receptors 206 and in the outer ends of the elongate support members 196 to engage the elongate support members 196 to the side rocker units 198. When so engaged, rocker 204, legs 202 and elongate support members 200 define first and second planes disposed at a right angle to a plane defined by elongate support members 196, as shown in FIG. 5C. Then the unfolded and locked bassinet body 12 may be slid onto the elongate support members 200 in the same manner that the body 12 is slid onto elongate support members 200. The user will hear the first buttons 212 snap into the T-shaped openings 216 and the user will see the ends 208 emerge from the open ends of the receptors 84 such that the ends 208 close off such open ends of the receptors 84. These audio and visual signals are present with each of bed base 14 and rocker base 194. When so locked, the bassinet receptacle 92 may be rocked.

To disengage the bassinet receptacle 92 from either the bed base 14 of the rocker base 194, the second button 110 is pushed, which pushes first button 212 from out of engagement with the T-shaped opening 216, which permits the user to slide the side support members 70, 72, and the body 12 as a whole including bassinet receptacle 92, off the elongate members 16, 18 of the bed base 14 or off the elongate members 200 of the rocker base 194.

Then, after the body 12 has been removed from the bed base 14, the proximal counter members 62 are turned horizontally and the frame of the bed base 14 is pushed into the bed, i.e., between the mattress support 36 and mattress 56, by pushing against the cross member 24, or by pushing against the legs 20, 22, or by pushing on the proximal ends of the elongate members 16, 18 until the cross support member 24 abuts the proximal side 42 of the mattress support 36. During such pushing, straps 28, 30 loosen but distal counter members 32, 34 remain engaged between the mattress support 36 and mattress 56 by the weight of the mattress 56 pinching the horizontal portion 58 of the distal counter members 32, 34 against the upper surface of the mattress support 36 such that in the evening before bed, for example, when the frame of the bed base 14 is pulled out for use at night, the distal counter members 32, 34 remain engaged such that the straps 28, 30 tighten when the proximal counter members 62 arrive by such pulling at the proximal sides 42, 64 of the respective mattress support 36 and mattress 56. Then the body 12 can again be slid onto the elongate support members 16, 18 for a night of sleep.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A bassinet apparatus comprising:

a) a base comprising first and second elongate support members spaced apart from each other, parallel to each other, and fixed relative to each other;

b) first and second side support members, the first side support member engagable to the first elongate support member, the second side support member engagable to the second elongate support member;

c) a first bassinet support member extending from the first side support member to the second side support member and a second bassinet support member extending from the first side support member to the second side support member;

d) the first side support member being pivotable relative to the first and second bassinet support members and the second side support member being pivotable relative to the first and second bassinet support members; and e) a bassinet receptacle engaged to and depending from the first and second bassinet support members, with the bassinet receptacle depending from the first and second bassinet support members when the bassinet receptacle is in use.

2. The bassinet apparatus of claim 1, wherein each of the first and second bassinet support members includes an intermediate section, wherein the intermediate section of the first bassinet support member is disposed transversely of the first and second elongate support members and wherein the intermediate section of the second bassinet support member is disposed transversely of the first and second elongate support members.

3. The bassinet apparatus of claim 1, wherein the first and second elongate support members define a first plane, wherein each of the first and second bassinet support members includes an intermediate section, wherein the intermediate sections of the first and second bassinet support members define a second plane, and wherein the second plane is disposed above the first plane.

4. The bassinet apparatus of claim 1, wherein each of the first and second side support members includes a lower portion and an upper portion, the first and second elongate support members engaging the lower portion, the first and second bassinet support members engaging the upper portion.

5. The bassinet apparatus of claim 1, wherein the first side support member is lockable on the first elongate support member to be fixed relative to the first elongate support member and wherein the second side support member is lockable on the second elongate support member to be fixed relative to the second elongate support member.

6. The bassinet apparatus of claim 1, wherein each of the first and second side support members is lockable and unlockable from a pivoting position with the first and second bassinet support members such that the first and second side support members may assume a fixed position relative to the first and second bassinet support members.

7. The bassinet apparatus of claim 1, wherein the bassinet receptacle includes at least one of a flexible side and flexible end.

8. The bassinet apparatus of claim 1, wherein intermediate sections of the first and second bassinet support members define a first plane, wherein each of the first and second side support members define a second plane, wherein each of the first and second side support members are lockable to the first and second bassinet support members, the first and second planes being oblique to each other when the first and second side support members are locked to the first and second bassinet support members.

9. The bassinet apparatus of claim 1, and further comprising at least one flexible strap portion engaged between the first side support member and the bassinet receptacle and at least one flexible strap portion engaged between the second side support member and the bassinet receptacle.

10. The bassinet apparatus of claim 1, wherein each of the first and second bassinet support members includes an intermediate section, the intermediate sections opposing each other in a first direction, the intermediate sections being spaced apart by a first distance defined by inner edges of the intermediate sections, wherein each of the first and second side support members includes a width extending in the first direction, said width being greater than the first distance such that, when the first and second side support members are pivoted, the first and second side support members become to be adjacent to the intermediate sections of the first and second bassinet support members.

11. The bassinet apparatus of claim 1, wherein said first bassinet support member includes opposite end portions that are spaced apart by a first distance, wherein said second bassinet support member includes opposite end portions that are spaced apart by said first distance, the opposite end portions engaging sides of the side support members, and inner ends of the side support members being spaced from each other and adjacent to each other when in an unlocked position and pivoted to an innermost position.

12. The bassinet apparatus of claim 1, and further comprising a flexible strap having proximal and distal ends, the proximal end of the flexible strap engaged to the base, and still further comprising a distal end counter member engaged to the distal end of said flexible strap, the distal end counter member having first and second pieces extending at a right angle relative to each other and being rigid relative to each other.

13. The bassinet apparatus of claim 1, wherein the base comprises:

a) at least one leg depending from the first elongate support member and at least one leg depending from the second elongate support member; and b) at least one traversing support member engaged between said legs that holds the legs in a spaced apart relation such that the first and second elongate support members are held in a spaced apart relation.

14. The bassinet apparatus of claim 1, wherein said base is a rocking base.

15. The bassinet apparatus of claim 1, wherein the first elongate support member includes a length greater than a length of the first side support member such that ends of the first elongate support member extend beyond sides of the first side support member, and wherein the second elongate support member includes a length greater than a length of the second side support member such that ends of the second elongate support member extend beyond sides of the second side support member.

16. A bassinet apparatus, comprising:

a) a bassinet receptacle having first and second opposing sides, first and second opposing ends, and a floor, a direction running from the first opposing side to the second opposing side defining a first direction;

b) first and second bassinet support members, the first and second bassinet support members engaging the bassinet receptacle, the bassinet receptacle depending from the first and second bassinet support members, with the bassinet receptacle depending from the first and second bassinet support members when the bassinet receptacle is in use;

c) first and second side support members, the first side support member pivotally engaged to each of the first and second bassinet support members such that the first side support member pivots about an axis parallel to the first direction, the second side support member pivotally engaged to each of the first and second bassinet support members such that the second side support member pivots about an axis parallel to the first direction; and d) a first flexible strap portion engaged between the first side support member and the bassinet receptacle and a second flexible strap portion engaged between the second side support member and the bassinet receptacle.

17. The bassinet apparatus of claim 16, and further comprising a base, the base comprising:

a) first and second elongate support members spaced apart from each other and parallel to each other;

b) the first side support member slideably engaging the first elongate support member and the second side support member slideably engaging the second elongate support member;

c) the first elongate support member including a length greater than a length of the first side support member such that ends of the first elongate support member extend beyond sides of the first side support member, and the second elongate support member including a length greater than a length of the second side support member such that ends of the second elongate support member extend beyond sides of the second side support member; and d) the base having a first location and a second location, the base being adjustable such that a distance between the first and second location is adjustable.

18. The bassinet apparatus of claim 16, and further comprising a base, the base comprising:

a) first and second elongate support members spaced apart from each other and parallel to each other;

b) the first side support member slideably engaging the first elongate support member and the second side support member slideably engaging the second elongate support member;

c) the first elongate support member including a length greater than a length of the first side support member such that ends of the first elongate support member extend beyond sides of the first side support member, and the second elongate support member including a length greater than a length of the second side support member such that ends of the second elongate support member extend beyond sides of the second side support member;

d) at least one leg; and e) at least one rocker engaged to said at least one leg.

* * * * *